US006492886B1

(12) United States Patent
Kushitani et al.

(10) Patent No.: US 6,492,886 B1
(45) Date of Patent: Dec. 10, 2002

(54) LAMINATED FILTER, DUPLEXER, AND MOBILE COMMUNICATION APPARATUS USING THE SAME

(75) Inventors: Hiroshi Kushitani, Izumisano; Toru Yamada, Katano; Makoto Fujikawa, Ikoma, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 13 days.

(21) Appl. No.: 09/613,554

(22) Filed: Jul. 10, 2000

(30) Foreign Application Priority Data

Jul. 8, 1999 (JP) ..... 11-194002

(51) Int. Cl.[7] ..... H01P 3/08; H01P 7/00; H01P 5/12

(52) U.S. Cl. ..... 333/204; 333/219; 333/134

(58) Field of Search ..... 333/202, 204, 333/205, 219, 134

(56) References Cited

U.S. PATENT DOCUMENTS 4,879,533 A * 11/1989 de Muro et al. ..... 333/206
5,448,209 A * 9/1995 Hirai et al. ..... 333/204
5,963,115 A * 10/1999 Holleboom et al. ..... 333/204
6,140,891 A * 10/2000 Nakakubo et al. ..... 333/204
6,191,669 B1 * 2/2001 Shigemura ..... 333/204

FOREIGN PATENT DOCUMENTS

| | | |
|---|---|---|
| EP | 0 917 235 A2 | 5/1999 |
| JP | 07226602 | 8/1995 |
| JP | 08008605 | 1/1996 |
| JP | 2001110209 A * | 4/2001 |

* cited by examiner

*Primary Examiner*—Patricia Nguyen
(74) *Attorney, Agent, or Firm*—Parkhurst & Wendel, LLP

(57) ABSTRACT

A laminated filter comprising a plurality of resonator electrodes, an inter-resonator coupling capacitor electrode for coupling adjacent resonators, and two input/output coupling capacitor electrodes for coupling input/output terminals and the resonator electrodes. This provides a capacitor electrode for electrically connecting one side of the input/output terminals with a portion of the input/output coupling capacitor electrode, wherein the input/output coupling capacitor electrode and the capacitor electrode are a parallel circuit. This structure forms a parallel resonance circuit in the input/output terminal, to provide an additional attenuation pole besides an attenuation pole formed by electromagnetic coupling between the resonators and an inter-resonator capacitance, thereby realizing a laminated filter of a high attenuation. With this structure, a duplexer can be made using a plurality of the filters of this invention without requiring a phase-shifting circuit.

28 Claims, 19 Drawing Sheets

LAMINATED FILTER, DUPLEXER, AND MOBILE COMMUNICATION APPARATUS USING THE SAME

FIELD OF THE INVENTION

The present invention relates to a laminated filter and a duplexer used mainly for a radio frequency device such as a portable telephone and the like, and a mobile communication apparatus using the same.

BACKGROUND OF THE INVENTION

A laminated filter of the prior art generally comprises dielectric layers 1401*a*, 1401*b*, 1401*c*, 1401*d* and 1401*e*, resonator electrodes 1402*a* and 1402*b*, load capacitor electrodes 1403*a* and 1403*b*, an inter-resonator coupling capacitor electrode 1404, input/output coupling capacitor electrodes 1405*a* and 1405*b*, and shielding electrodes 1406*a* and 1406*b*, as shown in FIG. 14A.

Ends of the electrodes 1402*a* and 1402*b*, and the electrodes 1406*a* and 1406*b* are connected to a grounding terminal electrode 1408*a* provided on a side surface of a dielectric, and, ends of the electrodes 1403*a* and 1403*b*, and the electrodes 1406*a* and 1406*b* are connected to a grounding terminal electrode 1408*b* on another side surface of the dielectric. The electrode 1405*a* is connected to an input/output terminal electrode 1407*a* provided on a side surface of the dielectric, and the electrode 1405*b* is connected to another input/output terminal electrode 1407*b* provided on another side surface of the dielectric. The electrodes 1408*a* and 1408*b* are grounded to constitute a structure.

Each of the electrodes in the above-described laminated filter functions as a stripline in a microwave band for which this laminated filter is used, since the electrodes are formed in the dielectric. Therefore, an equivalent circuit of this laminated filter is represented by FIG. 14B in the microwave band. In FIG. 14B, inductors 1613 and 1615, respectively, represent inductance components of the electrodes 1403*a* and 1403*b*. An inductor 1606 represents an inductance component of the electrode 1404. Furthermore, inductors 1603 and 1609 represent inductance components of the electrodes 1405*a* and 1405*b*, respectively.

In the above structure, the electrodes 1402*a* and 1402*b* act as quarter-wave resonators, since they are grounded at one end. Moreover, because the electrode 1404 and the electrodes 1402*a* and 1402*b*, as well as the electrodes 1405*a* and 1405*b* and the electrodes 1402*a* and 1402*b* compose parallel plate capacitors between them, they provide capacitive couplings between input/output terminals and the resonators, and also between the resonators. Furthermore, an attenuation pole (a frequency at which an impedance between the input/output terminals increases) can be formed in a transmission characteristic with an electromagnetic coupling obtained by adjusting widths of and a space between the electrodes 1402*a* and 1402*b*, and a capacitance obtained by adjusting the parallel plate capacitors formed between the electrodes 1404, and 1402*a* and 1402*b*.

As a result, the attenuation pole is formed at one side of a pass band 1701 in the transmission characteristic between the input/output terminals, as shown in FIG. 14C, thereby serving as a band-pass filter having an attenuation band 1702 in vicinity of the pass band 1701.

In addition, a duplexer of the prior art comprises a receiving filter 1501, a transmission filter 1502, and a phase-shifting circuit 1503, as shown in FIG. 15, and one end of the receiving filter 1501 serves as a receiving terminal 1510, and one end of the transmission filter 1502 as a transmission terminal 1511.

The phase-shifting circuit 1503 comprises an inductor 1504, another inductor 1505, a capacitor 1506, a capacitor 1507, and another capacitor 1508. In the duplexer, the capacitor 1506, the inductor 1504, and the capacitor 1507 are designed to become equivalent to a transmission line, which is approximately one quarter of a wavelength at a pass band frequency of the transmission filter 1502. The capacitor 1507, the inductor 1505, and the capacitor 1508 are also designed to become equivalent to a transmission line, which is approximately one quarter of a wavelength at a pass band frequency of the receiving filter 1501.

Of a transmission signal input from the transmission terminal 1511, only a signal component having the pass band frequency passes through the transmission filter 1502, and it is fed to the phase-shifting circuit 1503. The receiving filter 1501, as observed from a common terminal 1509, shows high impedance in this case, and thereby the transmission signal is output from the common terminal 1509 without flowing into a path toward the receiving filter 1501. On the other hand, a receiving signal input from the common terminal 1509 is fed to the phase-shifting circuit 1503. However, the signal is input only to the receiving filter 1501 without flowing into a path toward the transmission filter 1502, since an impedance as observed from the common terminal 1509 toward the transmission filter 1502 side is high in this case, and therefore the signal is output to the receiving terminal 1510 only after a signal component having the pass band frequency of the receiving filter 1501 passes through.

Consequently, the transmission signal input from the transmission terminal 1511 is output from the common terminal 1509 via the phase-shifting circuit 1503 without being influenced by the receiving filter 1501. The receiving signal input from the common terminal 1509 is also output to the receiving terminal 1510 via the phase-shifting circuit 1503 without being influenced by the transmission filter 1502. Hence, the device functions as a duplexer.

The laminated type filter of the prior art had a problem that it needs to increase a number of resonators in order to gain a magnitude of attenuation, thereby resulting in a large size and an increase of an insertion loss in the pass band.

Moreover, the duplexer of the prior art also had a problem in that it needs a phase-shifting circuit consisting of an inductor and a capacitor of chip components, thereby requiring a large area of mounting surface.

The present invention is intended to address the above problems, and it aims at realizing a laminated filter having a low insertion loss and a high attenuation with a simple structure, and a duplexer of a small size with a small number of components.

SUMMARY OF THE INVENTION

In a laminated filter having a plurality of resonator electrodes, an inter-resonator coupling capacitor electrode for coupling between adjacent resonators, and two input/output coupling capacitor electrodes for coupling between input/output terminals and resonator electrodes, the present invention is to provide a capacitor electrode for electrically connecting one side of the input/output terminals with a portion of the input/output coupling capacitor electrode, wherein the input/output coupling capacitor electrode and the capacitor electrode comprise a parallel circuit.

This composition forms a parallel resonance circuit in one of the input/output terminals, and provides an additional attenuation pole besides another attenuation pole formed with an electromagnetic coupling between the resonators and an inter-resonator capacitance, thereby realizing the laminated filter of a high magnitude of attenuation with the same shape as that of the prior art.

Moreover, in a laminated filter having a pass band in a first band, and an attenuation band in a second band, there is provided a parallel circuit as described above at one side of the input/output terminals, whereby an attenuation pole formed by the parallel circuit is set in the vicinity of the second band. Furthermore, in a laminated filter having an attenuation band in the first band and a pass band in a second band, there is provided a parallel circuit as described above at one side of the input/output terminals, whereby an attenuation pole formed by the parallel circuit is set in the vicinity of the first band. A duplexer of the present invention is composed by connecting these two laminated filters at the input/output terminals where the parallel circuits are provided, and using the connected point as a common terminal.

With the described structure, the duplexer can be realized without using a phase-shifting circuit, since majority of a signal component passing through either one of the laminated filters is input to the common terminal because the parallel circuit of the other laminated filter provides a high impedance.

BRIEF DESCRIPTION OF THE DRAWINGS

FIG. 1D is an impedance characteristic of the laminated filter of the first exemplary embodiment of this invention;

DESCRIPTION OF THE PREFERRED EMBODIMENTS

Exemplary embodiments of the present invention will be described hereinafter with reference to FIG. 1 through FIG. 13.

First Exemplary Embodiment

Figure 1A:
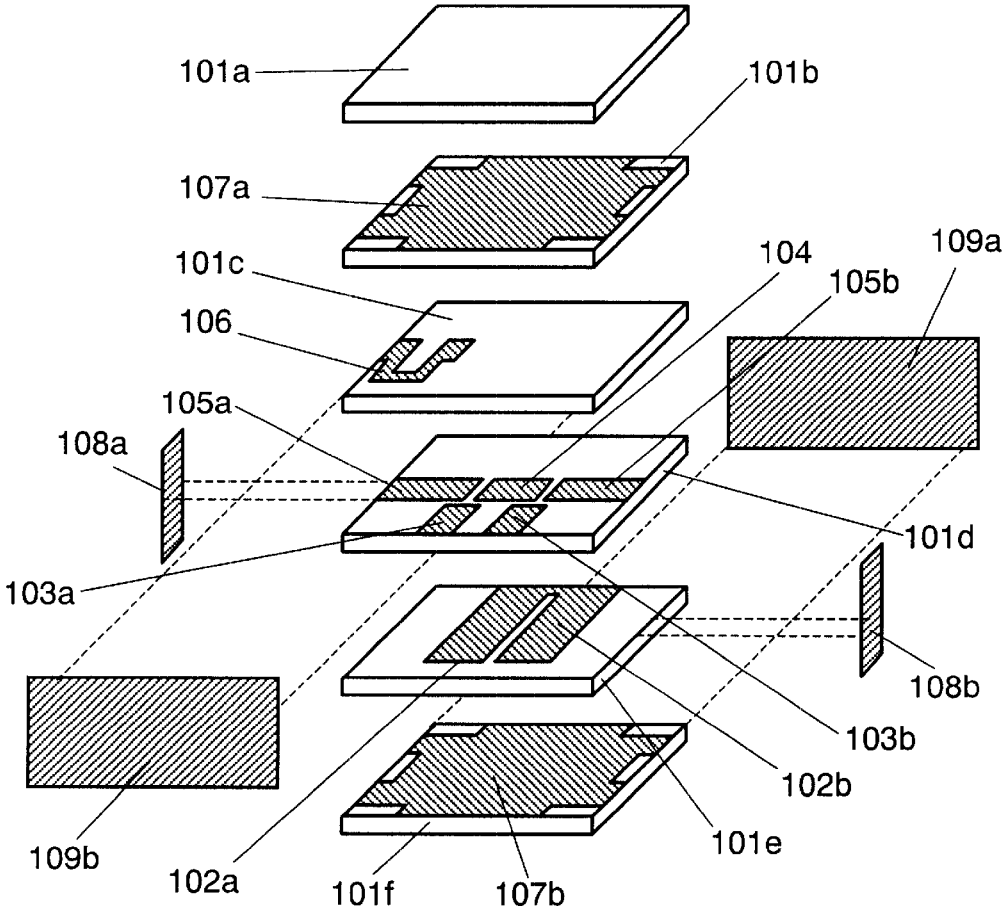
FIG. 1A is an exploded perspective view of a laminated filter of a first exemplary embodiment of the present invention.

FIG. 1A is an exploded perspective view of a laminated filter of a first exemplary embodiment of the present invention.

In FIG. 1A, the laminated filter comprises: dielectric layers 101*a*, 101*b*, 101*c*, 101*d*, 10le and 101*f* ; resonator electrodes 102*a* and 102*b*; load capacitor electrodes 103*a* and 103*b*; an inter-resonator coupling capacitor electrode 104; input/output coupling capacitor electrodes 105*a* and 105*b*; a capacitor electrode 106; and shielding electrodes 107*a* and 107*b*, and it has an integrated configuration. One ends of the electrodes 102*a* and 102*b*, and the electrodes 107*a* and 107*b* are connected to a grounding terminal electrode 109*a* provided on a side surface of a dielectric. One ends of the electrodes 103*a* and 103*b*, and the electrodes 107*a* and 107*b* are connected to another grounding terminal electrode 109*b* provided on another side surface of the dielectric. One ends of the electrode 105*a* and the electrode 106 are connected to an input/output terminal electrode 108*a* provided on one side surface of the dielectric, the electrode 105*b* is connected to another input/output terminal electrode 108*b* provided on another side surface of the dielectric, and the grounding terminal electrodes 109*a* and 109*b* are grounded, to constitute a structure.

The operation of the laminated filter constructed above will be described below.

Figure 1B:
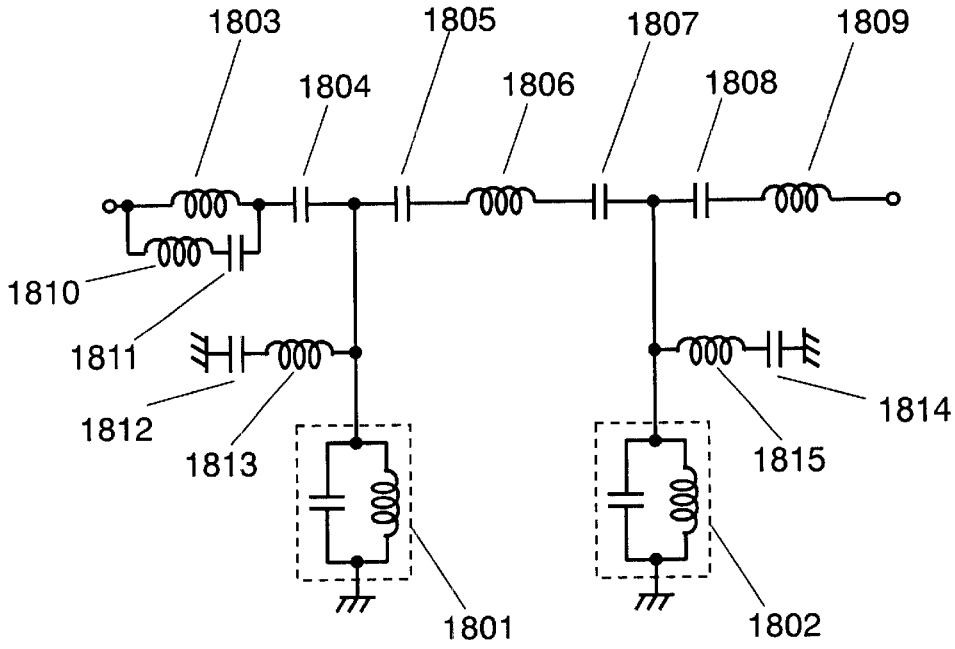
FIG. 1B is an equivalent circuit diagram of the laminated filter of the first exemplary embodiment of this invention, at frequencies in the vicinity of a pass band thereof.

Each of the electrodes in the above laminated filter functions as a stripline in a microwave band for which this laminated filter is used, since they are formed in the dielectric. Therefore, an equivalent circuit of this laminated filter can be shown as described in FIG. 1B in the microwave frequency band. In FIG. 1B, inductors 1813 and 1815, respectively, represent inductance components of the electrodes 103*a* and 103*b*. An inductor 1806 represents an inductance component of the electrode 104. Furthermore, inductors 1803 and 1809 represent inductance components of the electrodes 105*a* and 105*b*, respectively.

In the above structure, the electrodes 102*a* and 102*b* function as quarter-wave resonators, since they are grounded via the grounding terminal electrode 109*a*.

The electrodes 103*a* and 103*b* together with the electrodes 102*a* and 102*b* comprise parallel plate capacitors via the dielectric layer 101*d*, since they are arranged in such a manner that portions of them overlap with open ends of their respective electrodes 102*a* and 102*b*. These capacitors function as loading capacitors for adjusting resonance frequencies of resonators, since the electrodes 103*a* and 103*b* are grounded via the grounding terminal electrode 109*b*.

The electrode 104 comprise parallel plate capacitors with the electrodes 102*a* and 102*b* via the dielectric layer 101*d*, since it is arranged in an overlapping position with the electrodes 102*a* and 102*b*. These capacitors function as inter-resonator coupling capacitors.

The electrodes 105*a* and 105*b* together with the electrodes 102*a* and 102*b* comprise parallel plate capacitors via the dielectric layer 101*d*, since they are arranged in a manner that portions of them overlap with portions of their respective electrodes 102*a* and 102*b*. These capacitors function as input/output coupling capacitors.

As described above, this laminated body constitutes a tri-plate structure sandwiched between the shielding electrodes on top and bottom, and it functions as a two resonator mono-polar type band pass filter (Band Pass Filter, which will be hereinafter referred to as "BPF") of a capacitive coupling type, having one attenuation pole formed by an electromagnetic coupling between the two resonators and the inter-resonator coupling capacitor.

Further, the capacitor electrode 106 formed on an upper surface the dielectric layer 101*c* is so arranged that one end of it is connected to the input/output terminal electrode 108*a*, and the other end overlaps with a portion of the electrode 105*a*. With this structure, the electrode 105*a* and the electrode 106 form a parallel plate capacitor via the dielectric layer 101*c*, and this capacitor comprise a parallel circuit with the electrode 105*a*. The electrode 106 has an inductance component 1810, and the parallel plate capacitor is represented by a capacitor 1811 in FIG. 1B.

If an inductance "L" and a capacitance "C" are adjusted to satisfy the following simultaneous equations, the parallel circuit can possess a resonance point at a frequency of "ω", without interfering with an impedance of the original BPF in vicinity of its pass band:

$$1/(j\cdot\omega_0\cdot L_0)=j\cdot\omega_0\cdot C+1/(j\cdot_0\cdot L)\ \omega^{-2}=1/(L\cdot C) \qquad \text{(equations 1)}$$

where L0 represents an inductance of the electrode 105*a* before the electrode 106 is inserted, ω0 a pass band frequency of the BPF, L an inductance of the electrode 105*a* after the electrode 106 is inserted, C a capacitance of the parallel plate capacitor formed between the electrode 105*a* and the electrode 106, and ω a frequency of the newly formed attenuation pole.

Figure 1C:
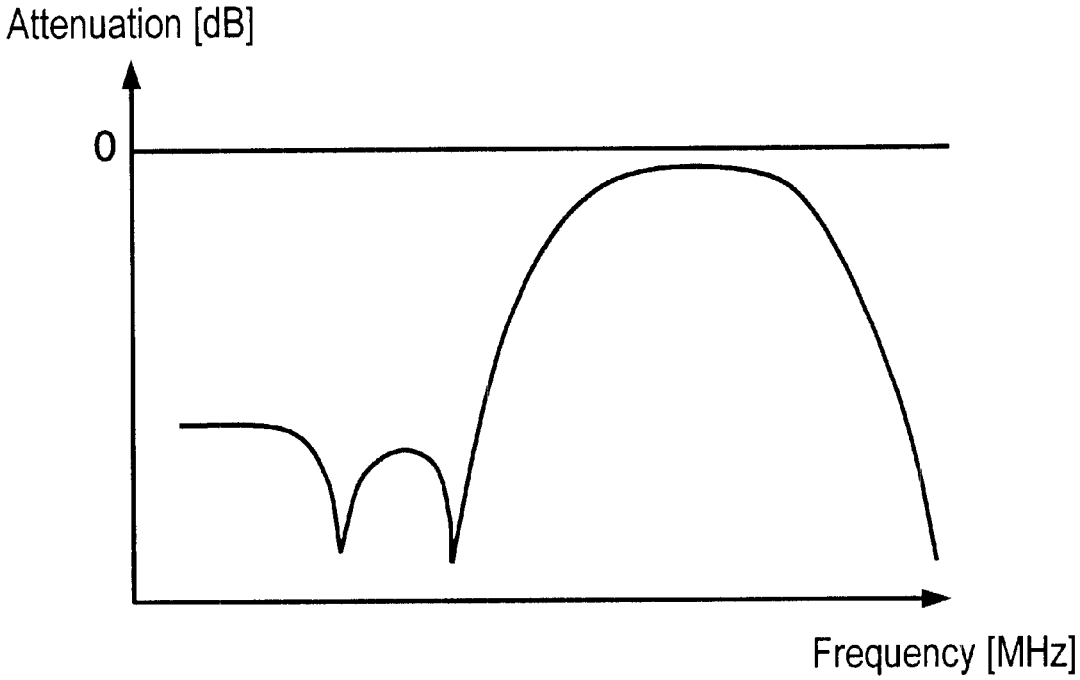
FIG. 1C is a frequency characteristic of the laminated filter of the first exemplary embodiment of this invention.

Accordingly, the laminated filter has a parallel resonance circuit in the input/output terminal, thereby gaining a passing characteristic as shown in FIG. 1C, wherein one attenuation pole is newly added while maintaining the original filtering property.

According to the above-described structure, this exemplary embodiment having the same shape as that of the prior art, functions as a BPF that can achieve a high magnitude of attenuation.

Figure 2:
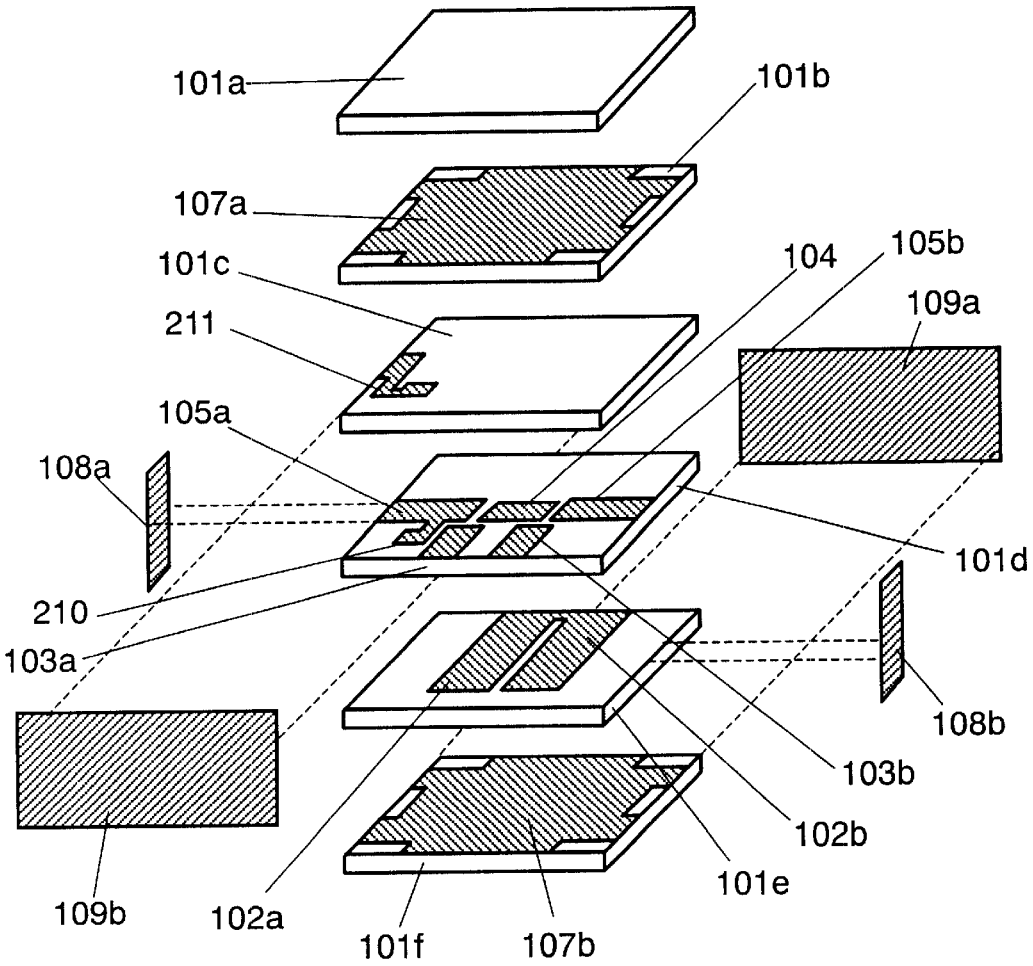
FIG. 2 is an exploded perspective view depicting another structural example of the laminated filter of the first exemplary embodiment of this invention.

In this exemplary embodiment, the capacitor electrode 106 is arranged in such a manner that one end of it is connected to the input/output terminal electrode and the other end overlaps with the input/output coupling capacitor electrode. However, a parallel plate capacitor may be formed by branching off a transmission line electrode 210 from the electrode 105*a*, as shown in FIG. 2, and arranging it in a manner that a portion of it overlaps with a capacitor electrode 211 connecting the electrode 108*a*. Accuracy in designing the BPF and the newly formed attenuation pole can be improved in this case, since it reduces a disorder in impedance of the input/output coupling capacitor electrode.

In addition, another electrode 106 may be formed on a rear surface of the dielectric layer 101*d* so as to sandwich the electrode 105*a* or the electrode 210 between a top and a bottom of it, by taking advantage of the laminated structure of this exemplary embodiment. This improves flexibility in designing the parallel resonance circuit, since it can increase a capacitance of the parallel plate capacitor with a same area.

In the BPF of this exemplary embodiment, the attenuation pole by the parallel circuit can be set anywhere near a first band, when the first band and a second band are designed respectively as an attenuation band and a pass band. A laminated type BPF of the prior art structure has an attenuation pole formed by an electromagnetic coupling between resonators and an inter-resonator coupling capacitor. It therefore has one attenuation pole in the attenuation band, if it employs two resonators. Since there can be composed two attenuation poles in the case of this exemplary embodiment, it can achieve not only an increase in magnitude of attenuation in the attenuation band, but also an expansion in bandwidth of the attenuation band at the same time.

Figure 3:
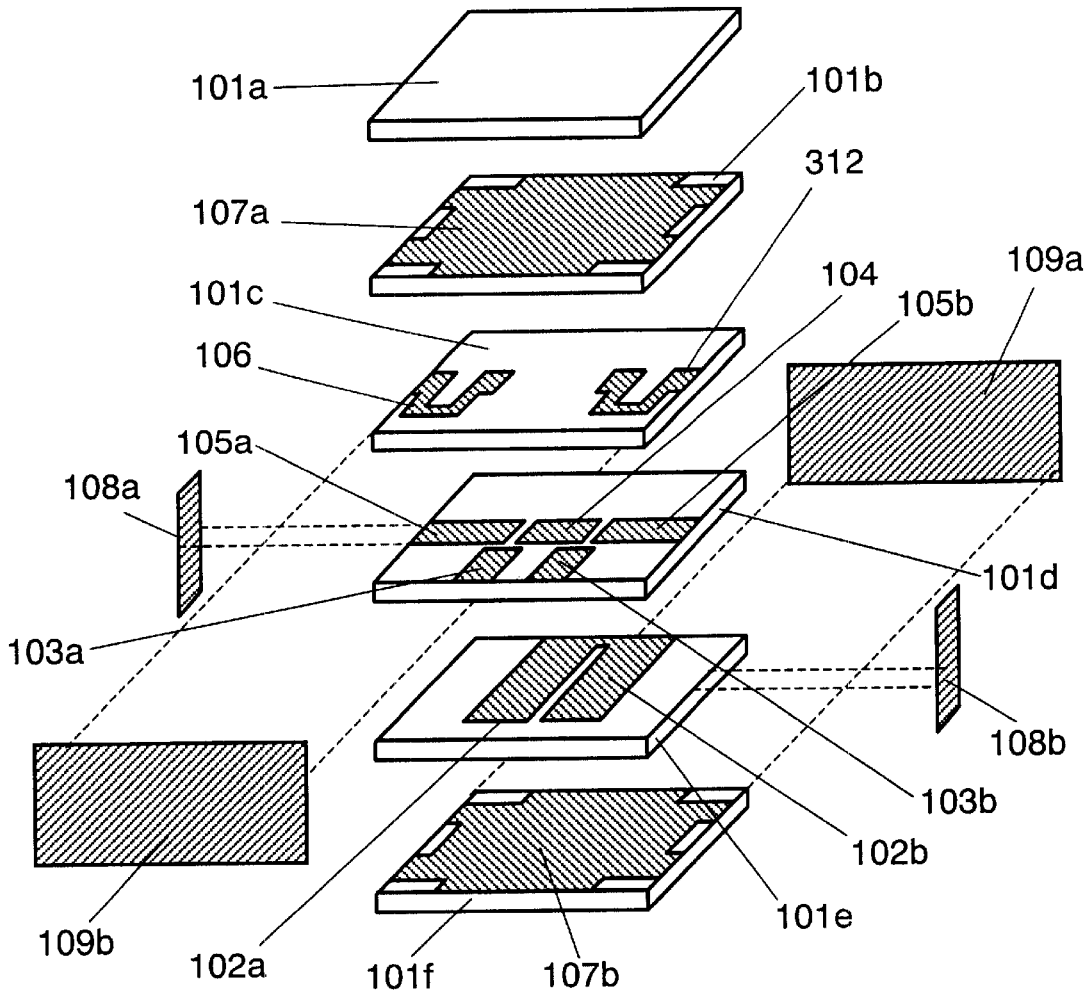
FIG. 3 is an exploded perspective view of yet another structural example of the laminated filter of the first exemplary embodiment of this invention.

Although the parallel circuit is provided in this exemplary embodiment only in a portion formed by one of the input/output coupling capacitor electrodes, 105*a*, and the electrode 106, another parallel circuit may be formed with the other input/output coupling capacitor electrode 105*b* by providing another electrode 312, as shown in FIG. 3. In this case, there is an effect of providing two additional attenuation poles. Because these two attenuation poles can be provided independently with respect to each other, various designs can be made possible such as setting them at both sides of the pass band, converging them in the attenuation band, and the like.

In this exemplary embodiment, although there is no other end surface electrode on the side surfaces where the electrodes 108*a* and 108*b* are formed, additional grounding terminal electrodes may be provided at both sides of the electrodes 108*a* and 108*b* , to make connections with the upper and the lower shielding electrodes for grounding. This improves the grounding of the laminated body, and improves the BPF characteristic.

Although there are many ways and methods of forming individual electrodes in the present exemplary embodiment, the above effectiveness of this invention is not influenced by the forming methods. Likewise, there are various kinds of materials adaptable for the electrodes and the dielectric bodies of this exemplary embodiment, and the effectiveness of this invention is not determined by any particular material.

The laminated filter of the present invention, if employed in a mobile communication apparatus, can suppress a large part of spurious signals while maintaining the same size, and thereby a mobile communication apparatus of superior performance can be constructed.

Second Exemplary Embodiment

Figure 4:
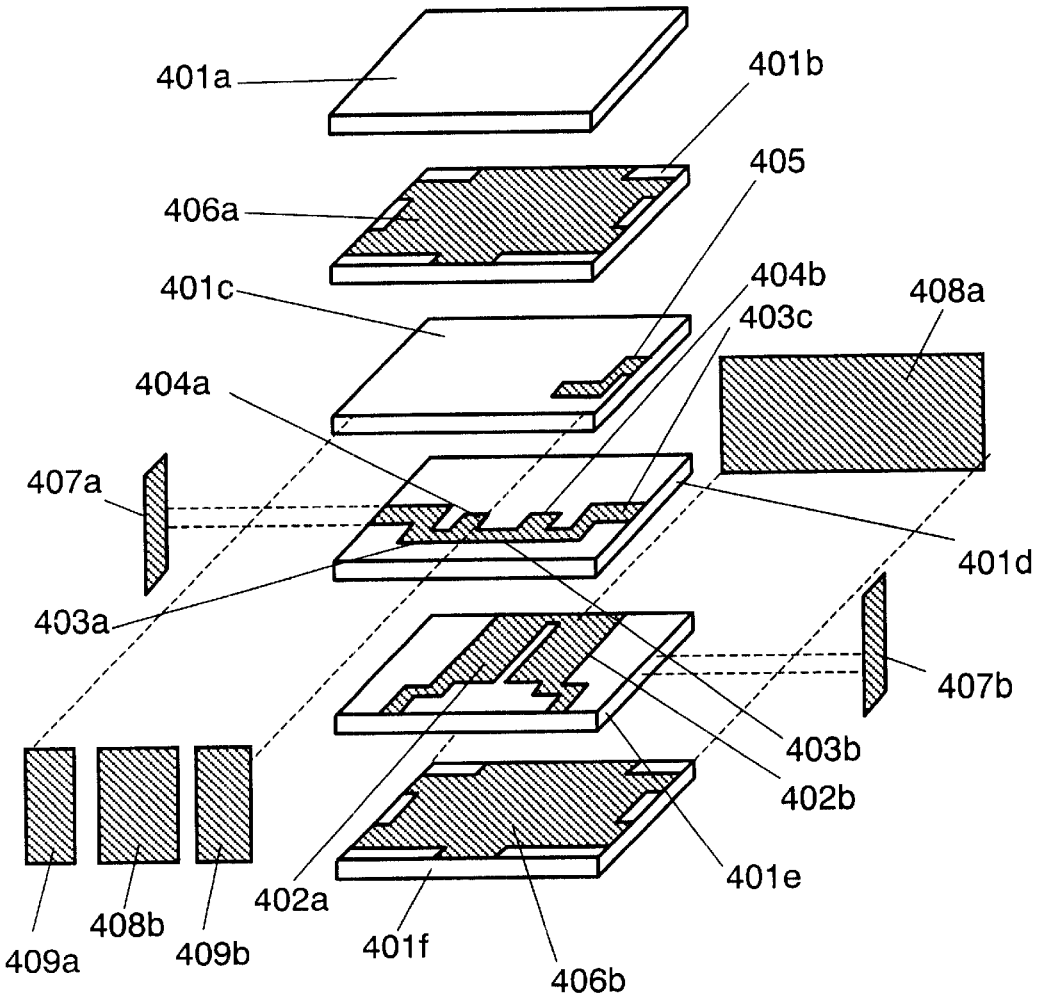
FIG. 4 is an exploded perspective view of a laminated filter of a second exemplary embodiment of this invention.

FIG. 4 is an exploded perspective view of a laminated filter of a second exemplary embodiment of the present invention.

In FIG. 4, the laminated filter having an integrated configuration comprises: dielectric layers 401*a*, 401*b*, 401*c*, 401*d*, 401*e* and 401*f*; resonator electrodes 402*a* and 402*b*; input-to-output terminal transmission line electrodes 403*a*, 403*b* and 403*c*; filtering capacitor electrodes 404*a*, and 404*b*; a capacitor electrode 405; and shielding electrodes 406*a* and 406*b*. One ends of the electrodes 402*a* and 402*b*, and the electrodes 406*a* and 406*b* are connected to a grounding terminal electrode 408*a* provided on a side surface of a dielectric. The other ends of the electrodes 402*a* and 402*b* are connected, respectively, to frequency adjusting terminal electrodes 409*a* and 409*b* provided on a side surface of the dielectric. One end of the electrode 403*a* is connected to an input/output terminal electrode 407*a* provided on a side surface of the dielectric. The other end of the electrode 403*a* and one end of the electrode 403*b* are connected to the electrode 404*a*. The other end of the electrode 403*b* and one end of the electrode 403*c* are connected to the electrode 404*b*. The other end of the electrode 403*c* and one end of the electrode 405 are connected to an electrode 407*b*. The electrodes 406*a* and 406*b* are connected to another electrode 408*b*, and these grounding terminal electrodes 408*a* and 408*b* are grounded, to comprise a filter structure.

The operation of the laminated filter constructed above will be described below.

The electrodes 402*a* and 402*b* act as quarter-wave resonators, since they are grounded via the electrode 408*a*. The electrodes 404*a* and 404*b* are arranged in such positions as to overlap with parts of the electrodes 402*a* and 402*b*, respectively, to form parallel plate capacitors with the electrodes 402*a* and 402*b* via the dielectric layer 401*d*. Therefore, the two resonators are in series connection to the transmission lines between the input/output terminals via the capacitors. As a result, the filter of this exemplary embodiment functions as a two resonator notch filter (Band Elimination Filter, hereinafter referred to as "BEF") which provides a high magnitude of attenuation at resonance frequencies of the series resonance circuits comprising the electrodes 402*a* and 402*b*.

Moreover, the electrodes 403*a*, 403*b* and 403*c*, i.e. transmission lines between the input/output terminals, function as coupling elements between two resonators, and to external distributed constant lines, by way of adjusting lengths and line widths of the electrodes. Accordingly, this laminated body constitutes a tri-plate structure sandwiched between the shielding electrodes on top and bottom, and the two resonators are connected in parallel via the transmission line, thereby functioning as a two resonator BEF having the electrodes 407*a* and 407*b* serving as terminals.

Further, the capacitor electrode 405 formed on an upper surface of the dielectric layer 401*c* is so arranged that one end of it is connected to the electrode 407*b*, and the other end overlaps with a portion of the electrode 403*c*. With this structure, the electrode 403*c* and the electrode 405 form a parallel plate capacitor via the dielectric layer 401*c*, to comprise a parallel circuit between the electrode 405 and the electrode 403*c*.

If an inductance "L" and a capacitance "C" are adjusted to satisfy the following simultaneous equations, the parallel circuit can possess a resonance point at a frequency of "ω", without interfering with an impedance of the original BEF in vicinity of its pass band:

$$1/(j\cdot\omega_0\cdot L_0)=j\cdot_0C+1/(j\cdot\omega_0\cdot L)\quad \omega^2=1/(L\cdot C) \qquad \text{(equations 2)}$$

where L0 represents an inductance of the electrode 403*c* before the electrode 405 is inserted, ω0 a pass band frequency of the BEF, L an inductance of the electrode 403*c* after the electrode 405 is inserted, C a capacitance of the parallel plate capacitor formed between the electrode 403*c* and the electrode 405, and ω a frequency of a newly formed attenuation pole.

Accordingly, the laminated filter has a parallel resonance circuit between the input/output terminals, thereby gaining a passing characteristic having a new addition of attenuation pole while also maintaining the original filtering property.

According to the above-described structure, this exemplary embodiment having the same shape as that of the prior art, functions as a BEF that can achieve a high magnitude of attenuation.

Figure 5:
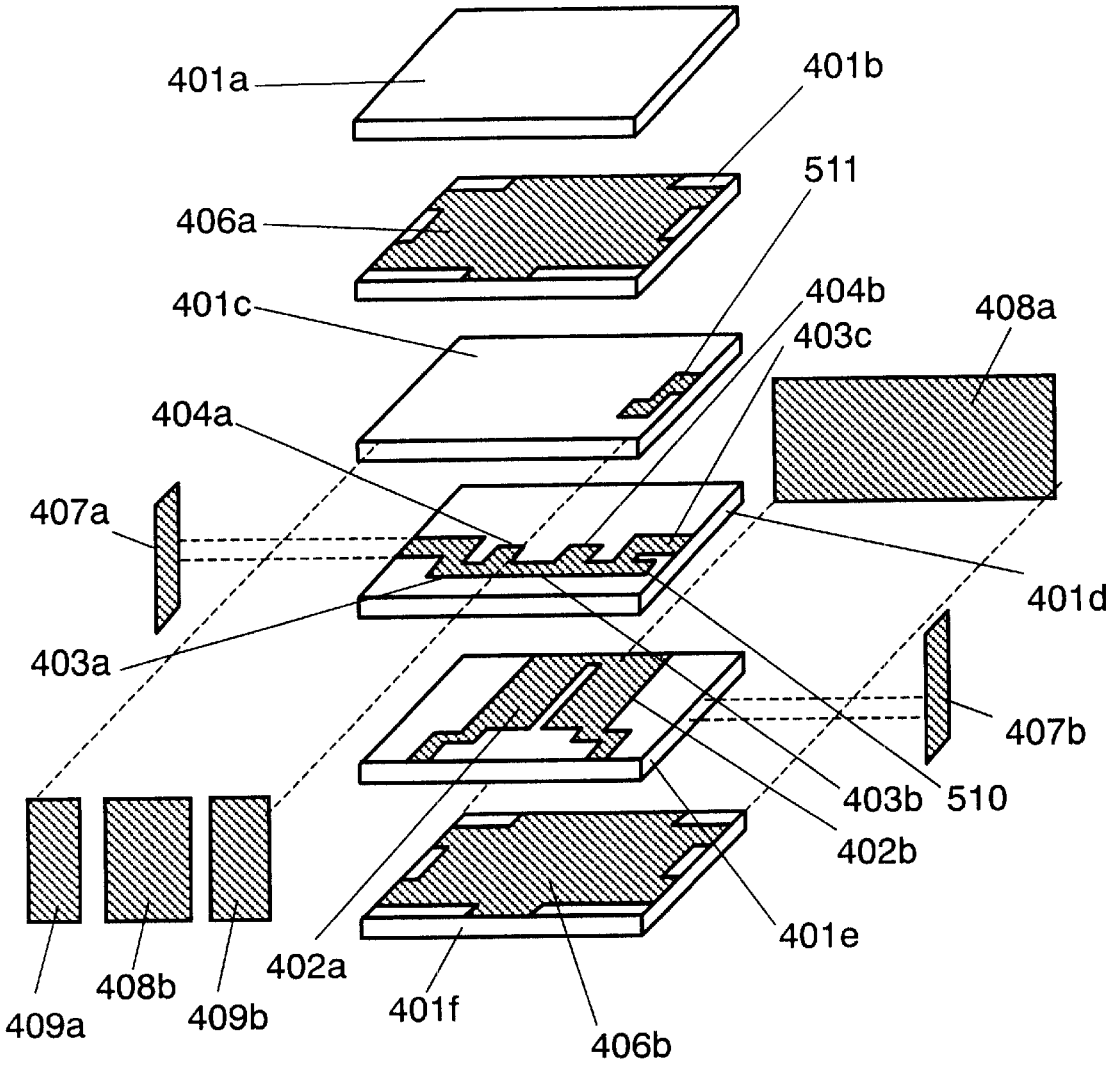
FIG. 5 is an exploded perspective view of another structural example of the laminated filter of the second exemplary embodiment of this invention.

In this exemplary embodiment, the capacitor electrode 405 is arranged in such a manner that one end of it is connected to the electrode 407*b* and the other end overlaps with the electrode 403*c*. However, a parallel plate capacitor may be formed by branching off a transmission line electrode 510 from the electrode 403*c*, as shown in FIG. 5, and arranging it in a manner that a portion of it overlaps with an electrode 511. Accuracy in designing the BEF and the newly formed attenuation pole can be improved in this case, since it reduces a disorder in impedance of the electrode 403*c*.

In addition, two capacitor electrodes may be formed to sandwich the electrode 403*c* or the electrode 510 between a top and a bottom of it, in the like manner as the first exemplary embodiment. This improves flexibility in designing the parallel resonance circuit, since it can increase a capacitance of the parallel plate capacitor with a same area.

In the BEF of this exemplary embodiment, the attenuation pole by the parallel circuit may be set anywhere near a second band, when a first band and the second band are designed respectively as a pass band and an attenuation band. A laminated type BEF of the prior art can have attenuation poles formed in number equal to a number of the resonators. It therefore has two attenuation poles in the attenuation band, if it employs two resonators. However, there can be three attenuation poles in the case of this exemplary embodiment, and it can thereby achieve an increase in magnitude of attenuation and also an expansion in bandwidth of the attenuation band at the same time.

Figure 6:
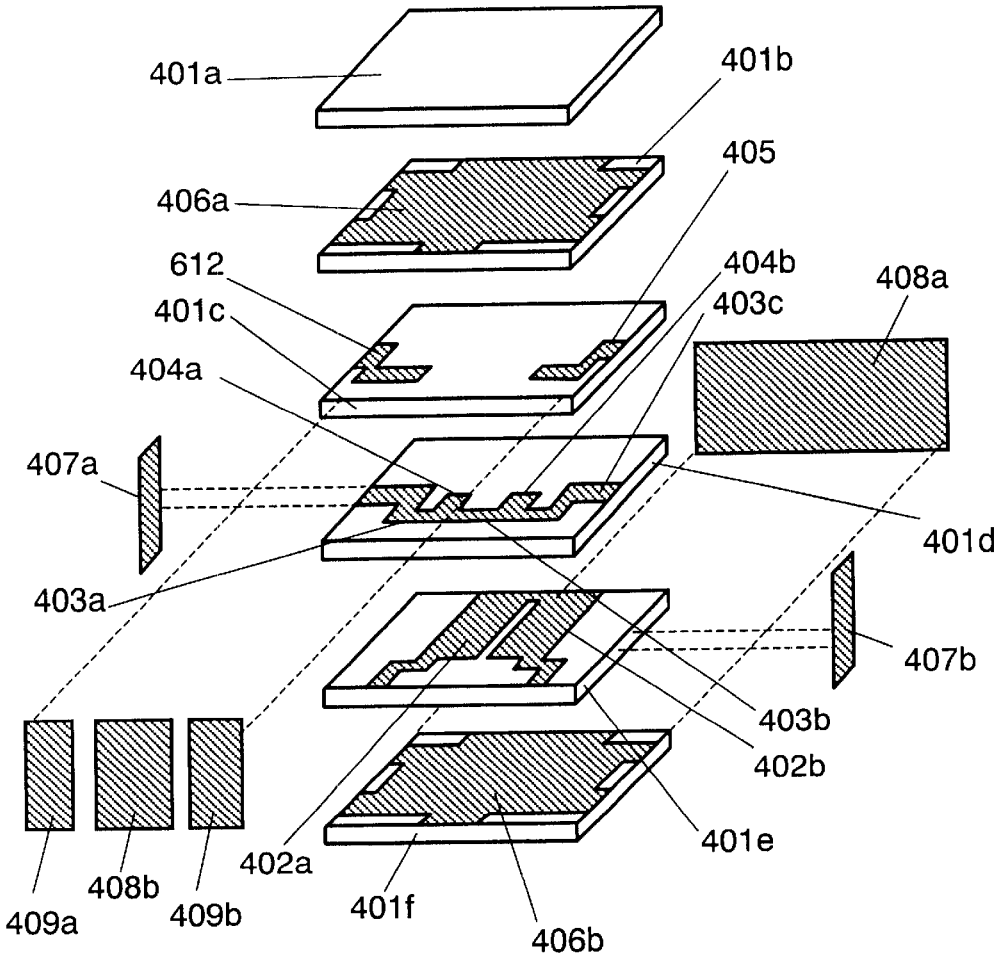
FIG. 6 is an exploded perspective view of still another structural example of the laminated filter of the second exemplary embodiment of this invention.

In this exemplary embodiment, although the parallel circuit is formed only in one of the electrodes, 403*c*, another parallel circuit may include the other electrode 403*a*, as shown in FIG. 6. In this case, there is an effect of providing two additional attenuation poles. Because these two attenuation poles are provided independently with respect to each other, various designs can be made possible such as setting them at both sides of the pass band, converging them in the attenuation band, and so on.

In this exemplary embodiment, although there is no other end surface electrode on the side surfaces where the input/output terminal electrodes are formed, additional grounding terminal electrodes may be provided at both sides of the terminal electrodes, to make connections with the upper and lower shielding electrodes for grounding. This enhances the grounding of the laminated body, and improves the BEF characteristic.

Third Exemplary Embodiment

Figure 7:
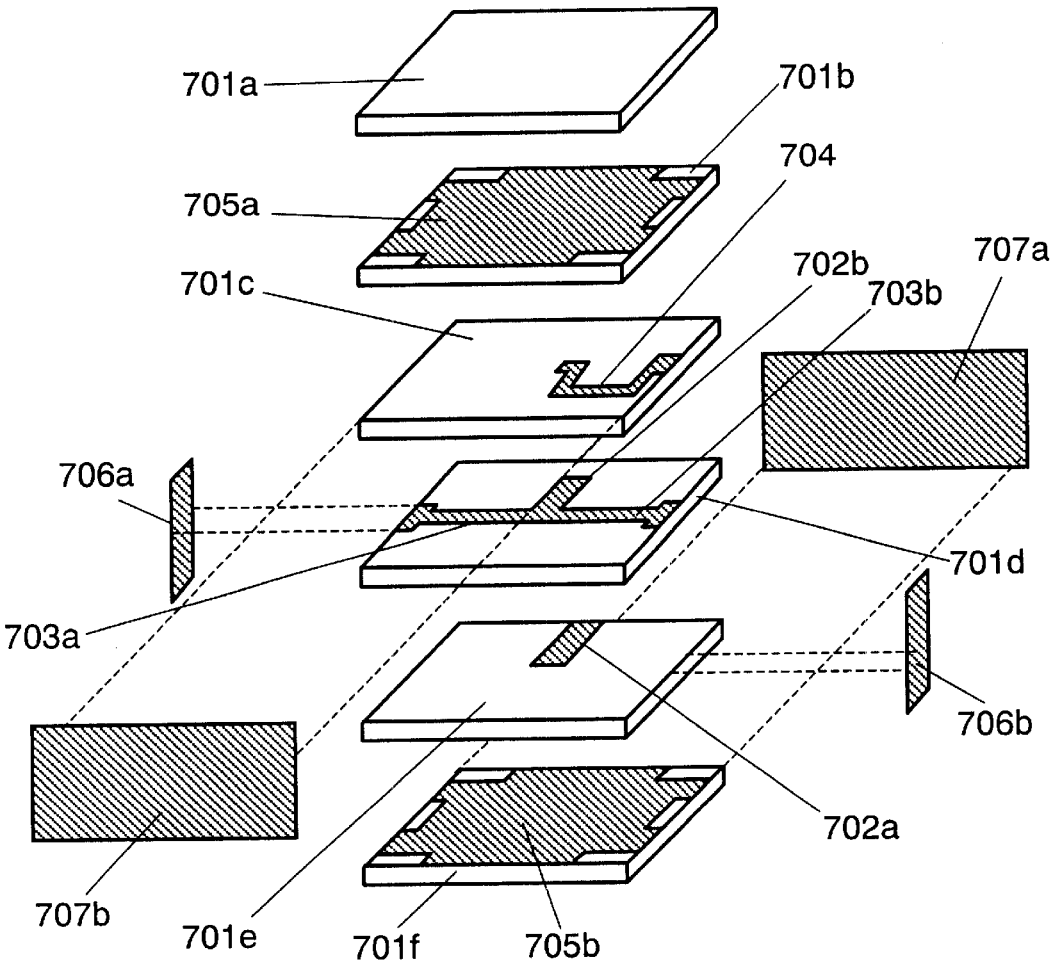
FIG. 7 is an exploded perspective view of a laminated filter of a third exemplary embodiment of this invention.

FIG. 7 is an exploded perspective view of a laminated filter of a third exemplary embodiment of the present invention.

In FIG. 7, the laminated filter having an integrated configuration comprises: dielectric layers 701*a*, 701*b*, 701*c*, 701*d*, 701*e* and 701*f*; capacitor electrodes 702*a* and 702*b*; transmission line electrodes 703*a* and 703*b*; a capacitor electrode 704; and shielding electrodes 705*a* and 705*b*. One end of the electrode 702*a* and the electrodes 705*a* and 705*b* are connected to a grounding terminal electrode 707*a* provided on a side surface of a dielectric. One end of the electrode 703*a* is connected to an input/output terminal electrode 706*a* provided on a side surface of the dielectric. The other end of the electrode 703*a* and one end of the electrodes 703*b* are connected to one end of the electrode 702*b*. The other end of the electrode 703*b* and one end of the electrode 704 are connected to an input/output terminal electrode 706*b* provided on another side surface of the dielectric. The electrodes 705*a* and 705*b* are connected with an electrode 707*b*, and the electrodes 707*a* and 707*b* are grounded, to constitute a filter structure.

The laminated filter constructed as above operates in a manner, which will be described hereinafter.

The electrodes 702*a* and 702*b* are arranged in a manner that portions of them overlap with each other, to form a parallel plate capacitor via the dielectric layer 701*d*. Also, the electrodes 703*a* and 703*b* function as inductors between the input/output terminals, and the above capacitor functions as a capacitor disposed between transmission lines connecting the input/output terminals and a ground. Therefore, this laminated body comprises a tri-plate structure sandwiched between the shielding electrodes on top and bottom, and functions as a T-type three element low pass filter (Low Pass Filter, hereinafter referred to as "LPF") having the electrodes 706*a* and 706*b* serving as terminals.

Further, the capacitor electrode 704 formed on an upper surface of the dielectric layer 701*c* is arranged so that one end of it is connected to the electrode 706*b*, and the other end overlaps with a portion of the electrode 703*b*. With this structure, the electrode 703*b* and the electrode 704 form a parallel plate capacitor via the dielectric layer 701*c*, to comprise a parallel circuit between the electrode 704 and the electrode 703*b*. If an inductance "L" and a capacitance "C" are adjusted to satisfy the following simultaneous equations, the parallel circuit can possess a resonance point at a frequency of "ω", without interfering with an impedance of the original LPF in vicinity of its pass band:

$$1/(j\cdot\omega_0\cdot L_0)=j\cdot\omega_0\cdot C+1/(j\cdot\omega_0\cdot L)\ \omega^{-2}=1/(L\cdot C) \qquad \text{(equations 3)}$$

where L0 represents an inductance of the electrode 703*b* before the electrode 704 is inserted, ω0 a pass band frequency of the LPF, L an inductance of the electrode 703*b* after the electrode 704 is inserted, C a capacitance of the capacitor formed between the electrode 703*b* and the electrode 704, and ω a frequency of a newly formed attenuation pole.

Accordingly, this laminated body comprises the tri-plate structure sandwiched between the shielding electrodes on top and bottom, thereby gaining a passing characteristic having a new addition of attenuation pole while also maintaining the original filtering property.

According to the above-described structure, this exemplary embodiment having the same shape as that of the prior art, functions as an LPF that can achieve a high magnitude of attenuation.

Figure 8:
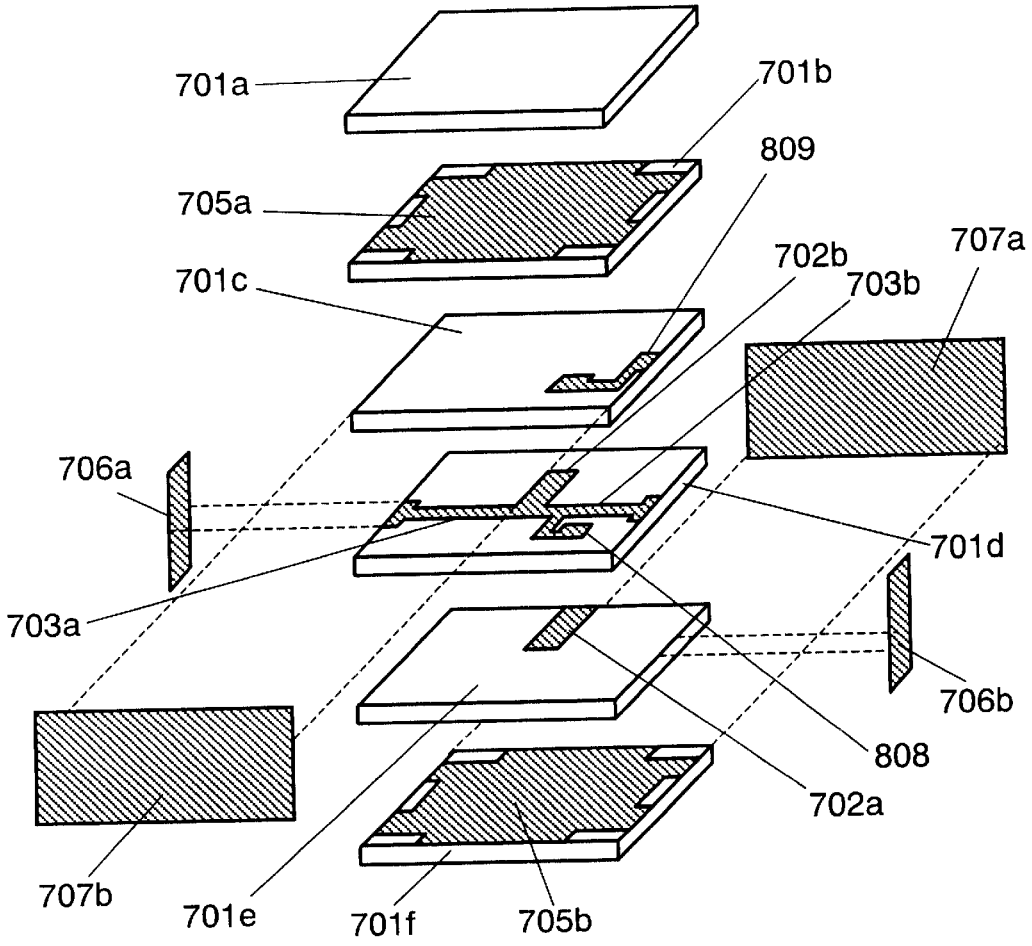
FIG. 8 is an exploded perspective view of another structural example of the laminated filter of the third exemplary embodiment of this invention.

In this exemplary embodiment, the capacitor electrode 704 is arranged in such a manner that one end of it is connected to the electrode 706*b* and the other end overlaps with the electrode 703*b*. However, a parallel plate capacitor may be formed by branching off a transmission line electrode 808 from the electrode 703*b*, as shown in FIG. 8, and arranging it in a manner that a portion of it overlaps with a capacitor electrode 809 connected to the input/output terminal electrode 706*b*. Accuracy in designing the LPF and the newly formed attenuation pole can be improved in this case, since it reduces a disorder in impedance of the filtering transmission line electrodes for the filter.

In addition, two capacitor electrodes may be formed to sandwich the electrode 703*b* or the electrode 808 between a top and a bottom thereof, in the like manner as the first exemplary embodiment. This improves flexibility in designing the parallel resonance circuit, since it can increase a capacitance of the parallel plate capacitor with a same area.

Figure 9:
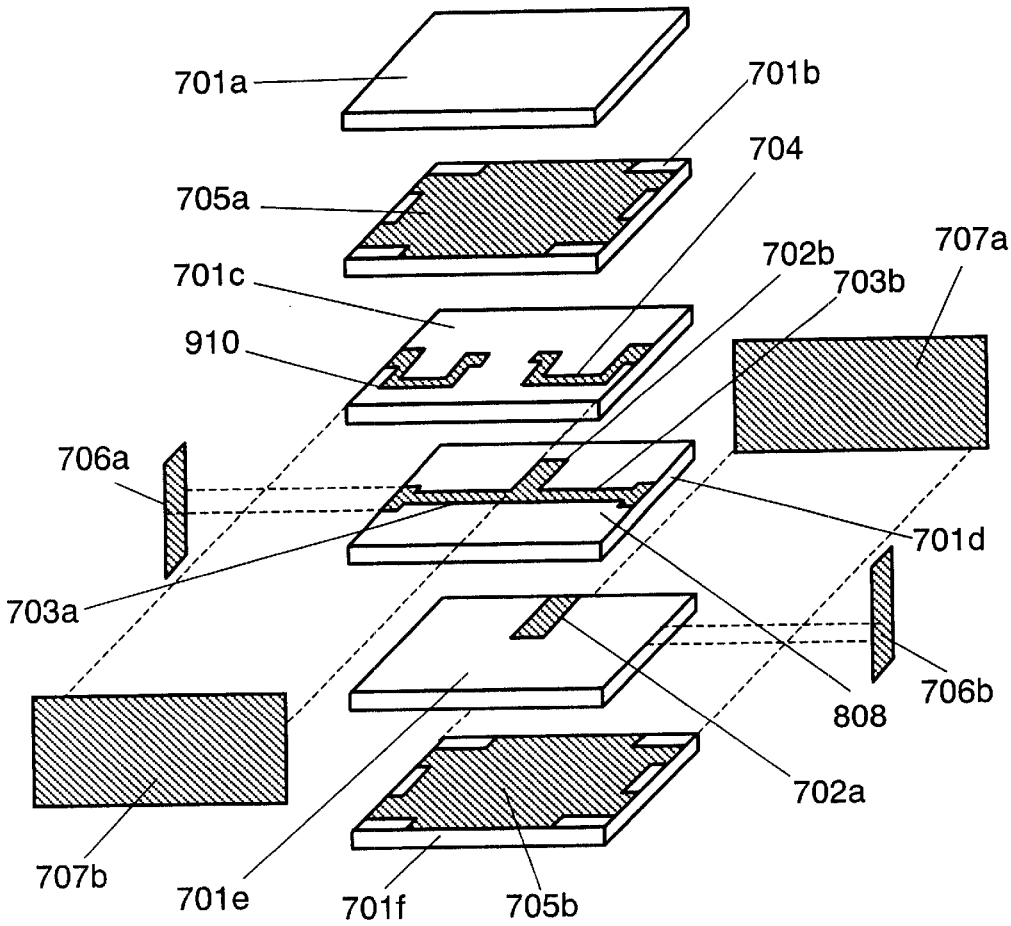
FIG. 9 is an exploded perspective view of still another structural example of the laminated filter of the third exemplary embodiment of this invention.

In this exemplary embodiment, although the parallel circuit is formed only in one of the electrodes, 703*b*, another parallel circuit may include the other electrode 703*a*, as shown in FIG. 9. In this case, there is an effect of providing two additional attenuation poles. Because these two attenuation poles are provided independently with respect to each other, various settings can be made possible.

In this exemplary embodiment, although there is no other end surface electrode on the side surfaces where the input/output terminal electrodes are formed, additional grounding terminal electrodes may be provided at both sides of the terminal electrodes, to make connections with the upper and lower shielding electrodes for grounding. This enhances the grounding of the laminated body, and improves the LPF characteristic.

Fourth Exemplary Embodiment

Figure 10:
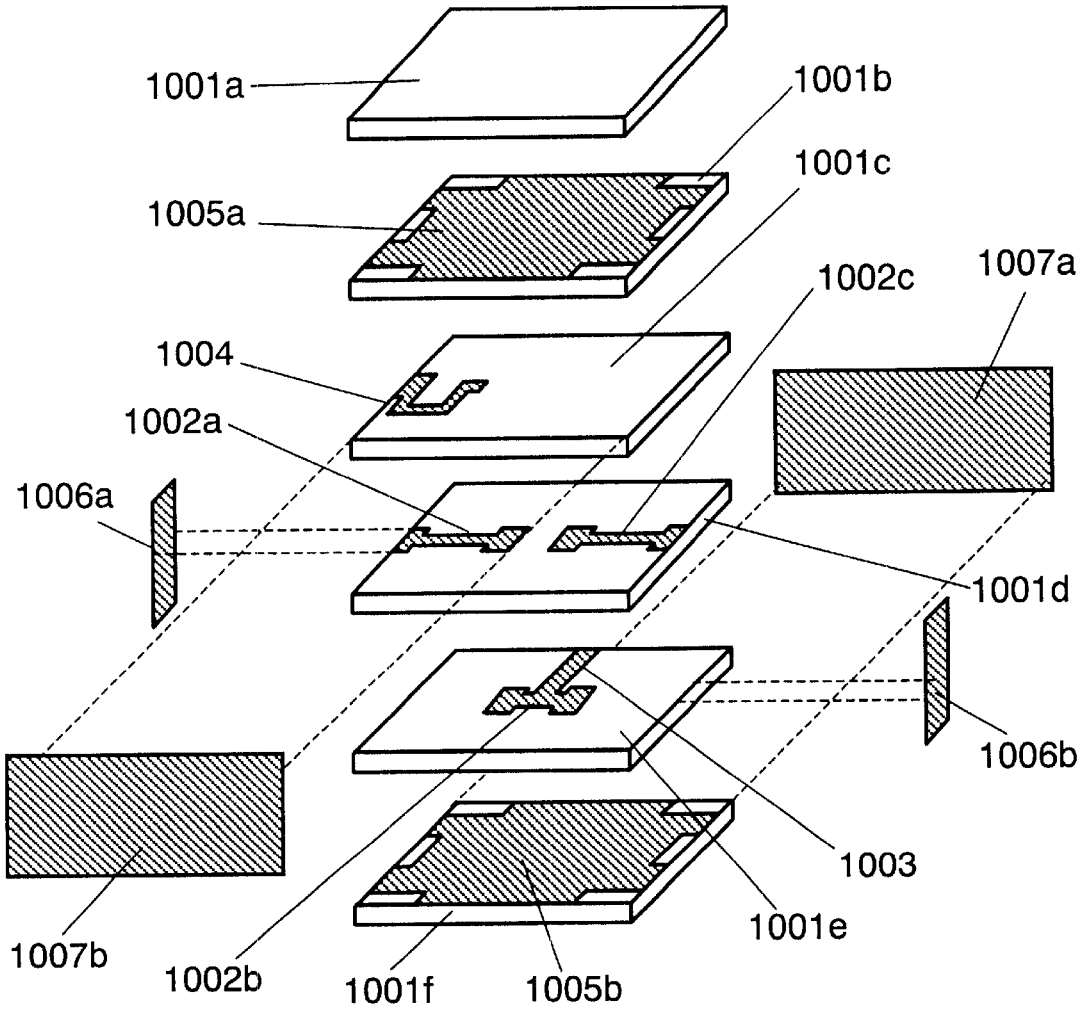
FIG. 10 is an exploded perspective view of a laminated filter of a fourth exemplary embodiment of this invention.

FIG. 10 is an exploded perspective view of a laminated filter of a fourth exemplary embodiment of the present invention.

In FIG. 10, the laminated filter having an integrated configuration comprises: dielectric layers 1001*a*, 1001*b*, 1001*c*, 1001*d*, 100le and 1001*f*; input/output terminal transmission line electrodes 1002*a*, 1002*b* and 1002*c*; a filtering transmission line electrode 1003; a capacitor electrode 1004; and shielding electrodes 1005*a* and 1005*b*. The electrodes 1002*a* and 1002*c* are formed on an upper surface of the dielectric layer 1001*d*. The electrodes 1002*b* and 1003 are formed on an upper surface of the dielectric layer 1001*e*. One end of the electrode 1002*a* and one end of the electrode 1004 are connected to an input/output terminal electrode 1006*a* provided on a side surface of a dielectric. The other end of the electrode 1002*a* and one end of the electrode 1002*b* are so arranged that portions of them overlap with each other via the dielectric layer 1001*d*. The other end of the electrode 1002*b* and one end of the electrode 1002*c* are also arranged so that portions of them overlap with each other via the dielectric layer 1001*d*. The other end of the electrode 1002*c* is connected to another input/output terminal electrode 1006*b* provided on a side surface of the dielectric. The transmission line electrode 1003 branched off from the electrode 1002*b*, the electrodes 1005*a* and 1005*b* are connected to a grounding terminal electrode 1007*a* provided on a side surface of the dielectric. The grounding electrodes 1007*a* and 1007*b* are grounded, to comprise a filter structure.

The operation of the laminated filter constructed above will be described below.

The electrodes 1002*a* and 1002*b* are arranged in a manner that portions of them overlap with each other, to form a parallel plate capacitor via the dielectric layer 1Old. The electrodes 1002*b* and 1002*c* are also arranged in a manner that portions of them overlap with each other, to form another parallel plate capacitor via the dielectric layer 1001*d*. Therefore, these two capacitors are in series connection between the input/output terminals. In addition, the electrode 1003 functions as an inductor between a connecting point of the two capacitors and the ground. Thus, the laminated body of this embodiment comprises a tri-plate structure sandwiched between the shielding electrodes on top and bottom, and it functions as a T-type three element high pass filter (High Pass Filter, which will be hereinafter referred to as "HPF") having the electrodes 1006*a* and 1006*b* serving as terminals.

The capacitor electrode 1004 formed on an upper surface of the dielectric layer 1001*c* is arranged so that one end of it is connected to the electrode 1006*a*, and the other end overlaps with a portion of the electrode 1002*a*. With this structure, the electrode 1002*a* and the electrode 1004 form a capacitor via the dielectric layer 1001*c*, and this capacitor comprises a parallel circuit with the electrode 1002*a*. If an inductance "L" and a capacitance "C" are adjusted to satisfy the following simultaneous equations, the parallel circuit can possess a resonance point at a frequency of "ω", without interfering with an impedance of the original HPF in vicinity of its pass band:

$$1/(j\cdot\omega_0\cdot L_0)=j\cdot\omega_0\cdot C+1/(j\cdot\omega_0\cdot L)\quad \omega^{-2}=1/(L\cdot C) \qquad \text{(equations 4)}$$

where L0 represents an inductance of the electrode 1002*a* before the electrode 1004 is inserted, ω a pass band frequency of the HPF, L an inductance of the electrode 1002*a* after the electrode 1004 is inserted, C a capacitance of the capacitor formed between the electrode 1002*a* and the electrode 1004, and w a frequency of a newly formed attenuation pole.

Accordingly, the filter of this exemplary embodiment has a parallel resonance circuit in the input/output terminal, thereby gaining a passing characteristic having a new addition of attenuation pole while also maintaining the original filtering property. According to the above-described structure, this exemplary embodiment having the same shape as that of the prior art, functions as an HPF that can achieve a high magnitude of attenuation.

Figure 11:
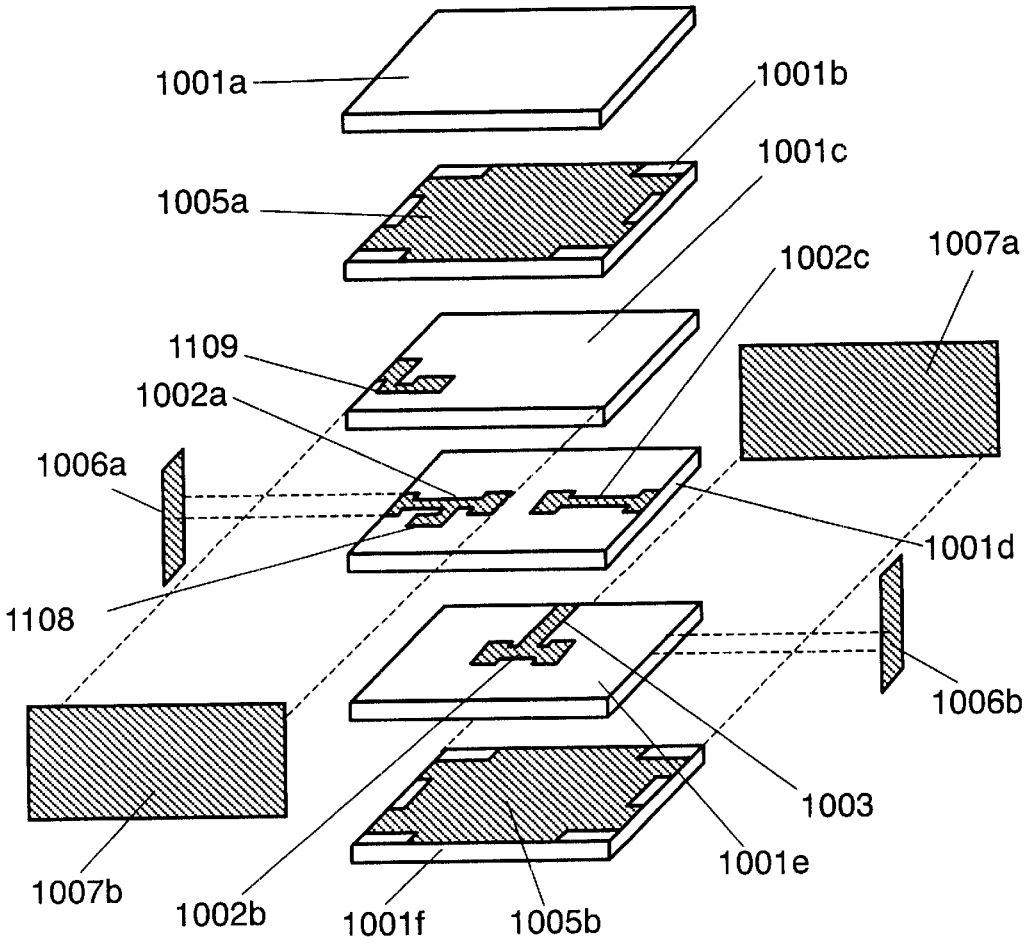
FIG. 11 is an exploded perspective view of another structural example of the laminated filter of the fourth exemplary embodiment of this invention.

In this exemplary embodiment, the electrode 1004 is arranged in such a manner that one end of it is connected to the electrode 1006*a* and the other end overlaps with the electrode 1002*a*. However, a capacitor may be formed by branching off a transmission line electrode 1108 from the electrode 1002*a*, as shown in FIG. 11, and arranging it in a manner that a portion of it overlaps with a capacitor electrode 1109 connected to the electrode 1006*a*. Accuracy in designing the HPF and the newly formed attenuation pole can be improved in this case, since it reduces a disorder in impedance of the electrode 1002*a*.

In addition, two capacitor electrodes may be formed to sandwich the electrode 1002*a* or the electrode 1108 between a top and a bottom of it, in the like manner as the first exemplary embodiment. This improves flexibility in designing the parallel resonance circuit, since it can increase a capacitance of the parallel plate capacitor with a same surface area.

Figure 12:
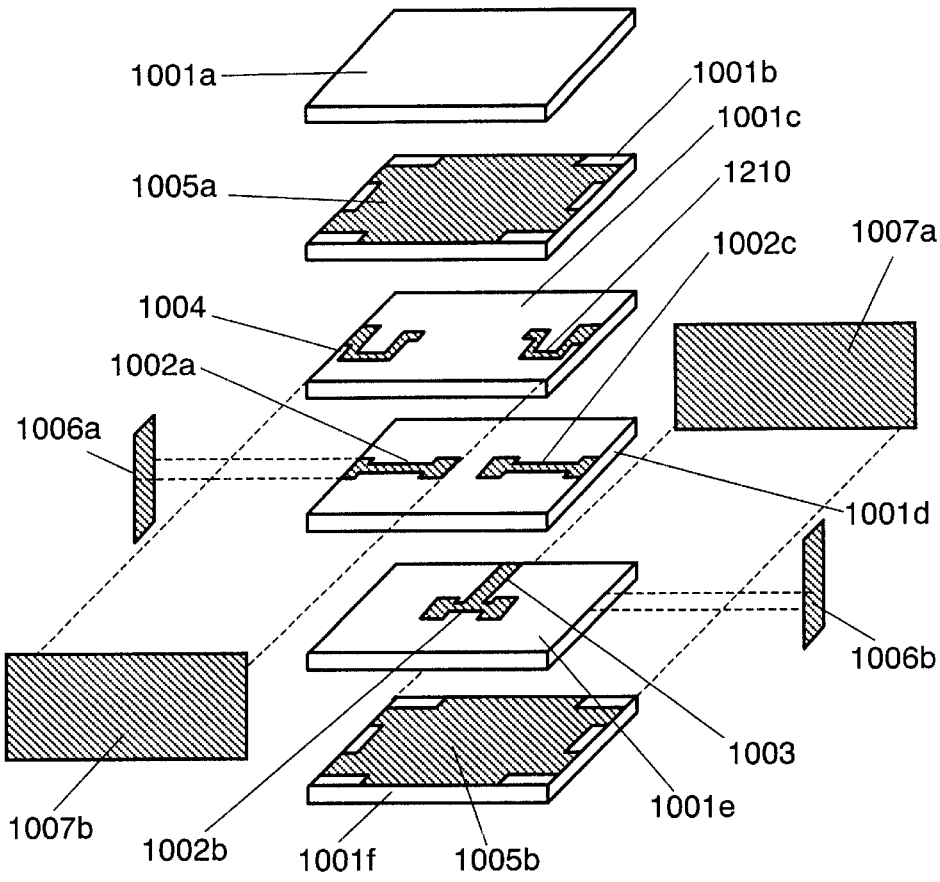
FIG. 12 is an exploded perspective view of still another structural example of the laminated filter of the fourth exemplary embodiment of this invention.

In this exemplary embodiment, although the parallel circuit is formed only with the electrode 1002*a* connecting with one of the electrodes, 1006*a*, another parallel circuit may include the electrode 1002*c* connecting with the other electrode 1006*b*, as shown in FIG. 12. In this case, there is an effect of providing two additional attenuation poles. Because these two attenuation poles are provided independently with respect to each other, various designs can be made possible.

In this exemplary embodiment, although there is no other end surface electrode on the side surfaces where the input/output terminal electrodes are formed, additional grounding terminal electrodes may be provided at both sides of the terminal electrodes, to make connections with the upper and lower shielding electrodes for grounding. This enhances the grounding of the laminated body, and improves the HPF characteristic.

Fifth Exemplary Embodiment

Figure 13:
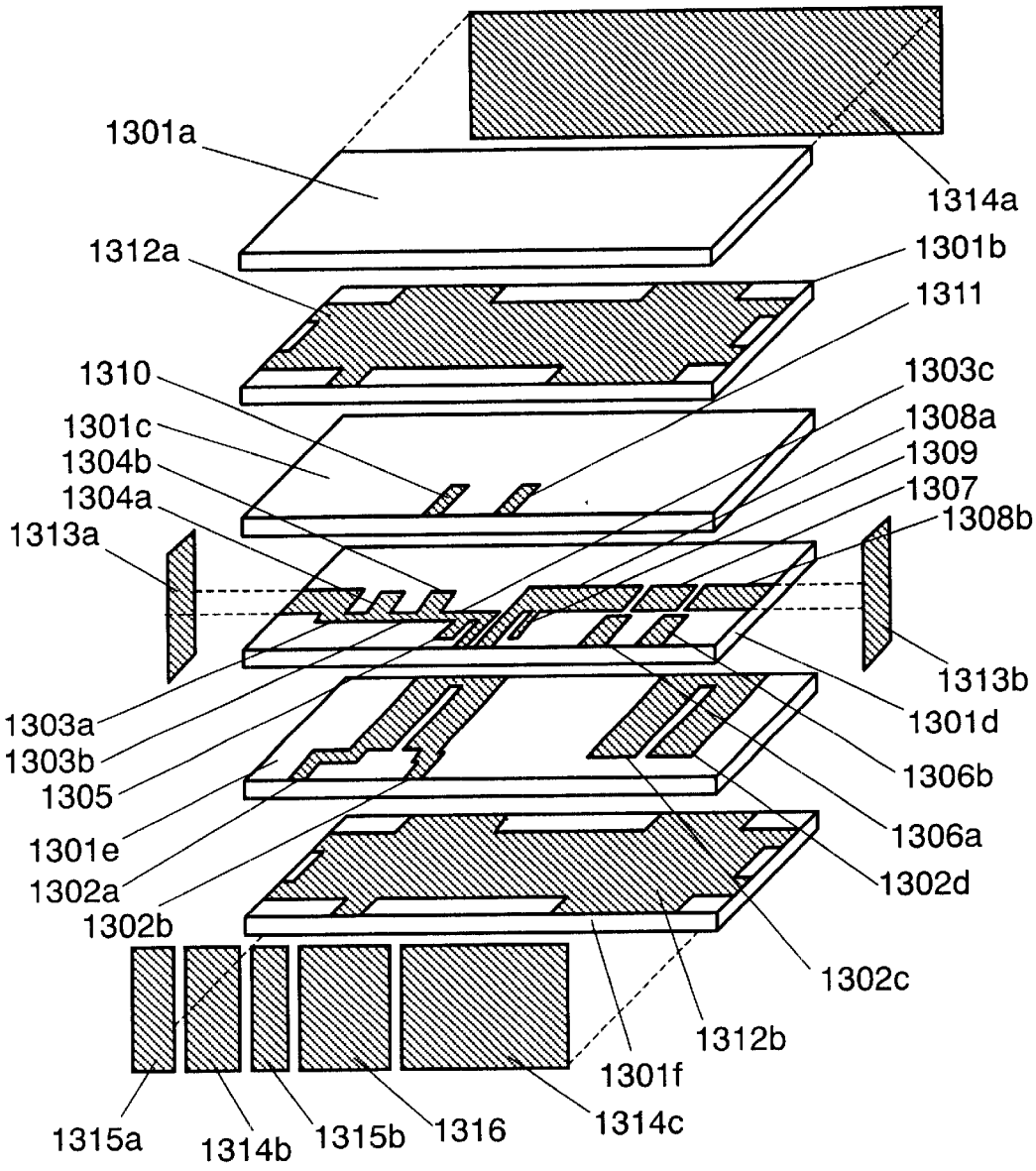
FIG. 13 is an exploded perspective view of a duplexer of a fifth exemplary embodiment of this invention.
Figure 14A:
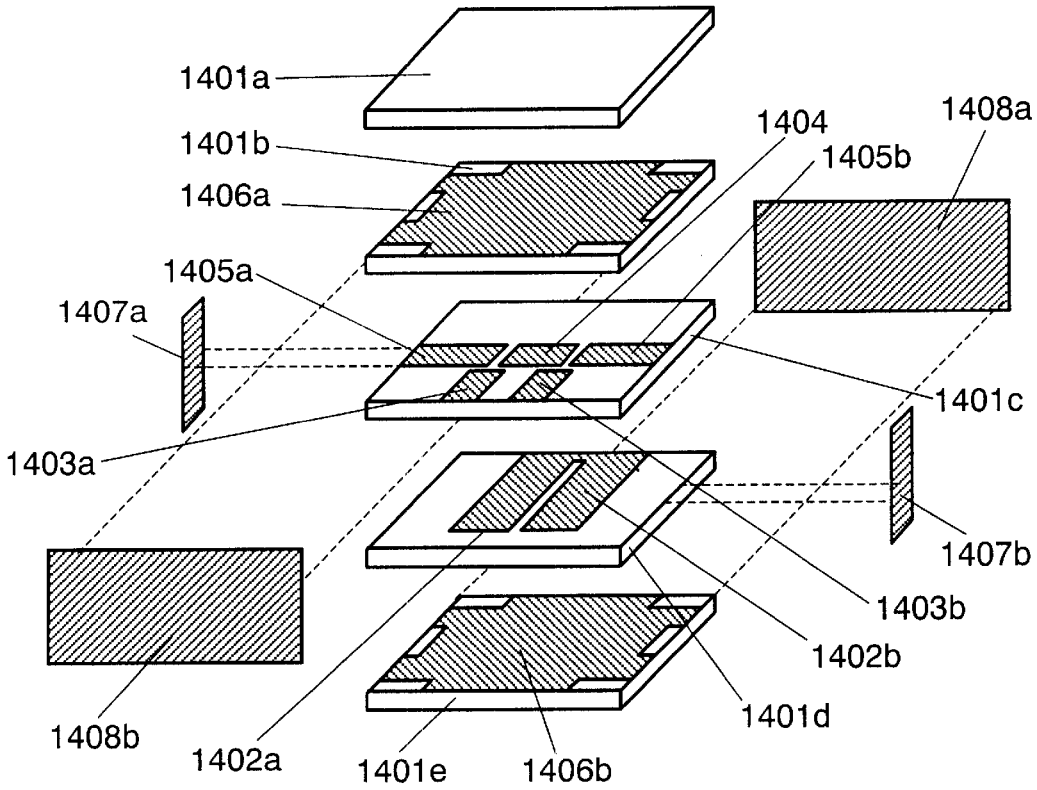
FIG. 14A Prior Art
FIG. 14A is an exploded perspective view of a laminated filter of the prior art.
Figure 14B:
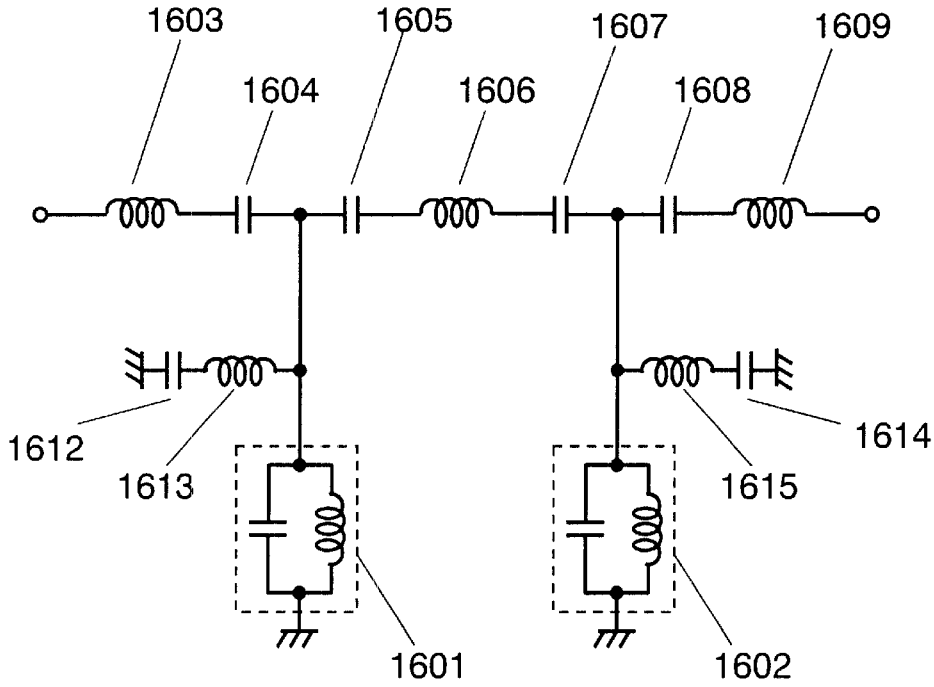
FIG. 14B Prior Art
FIG. 14B is an equivalent circuit diagram of the laminated filter of the prior art, in vicinity of a pass band thereof.
Figure 14C:
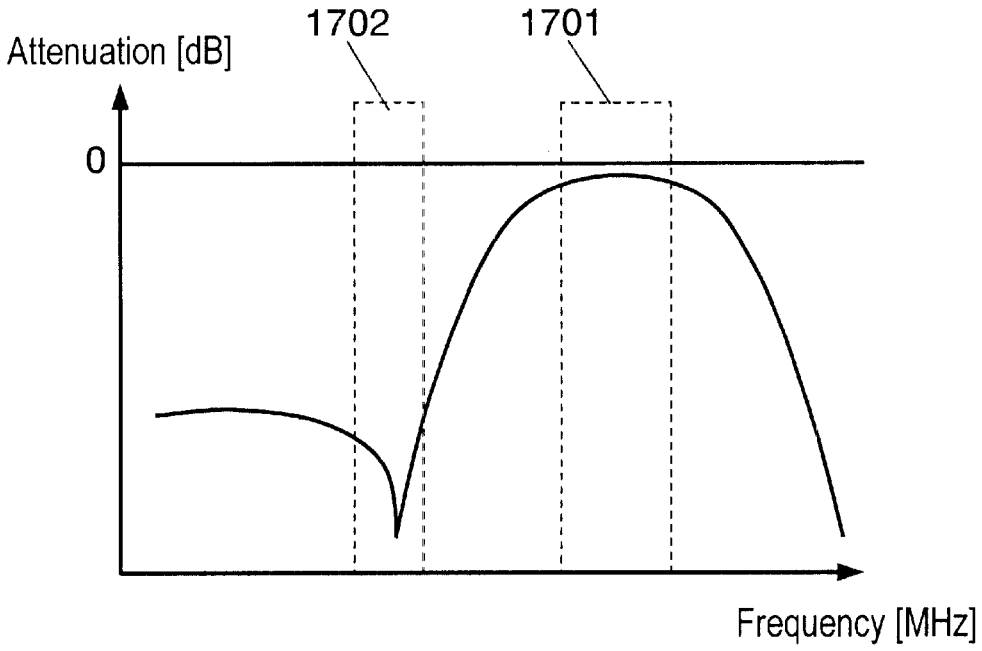
FIG. 14C Prior Art
FIG. 14C is a frequency characteristic of the laminated filter of the prior art.
Figure 15:
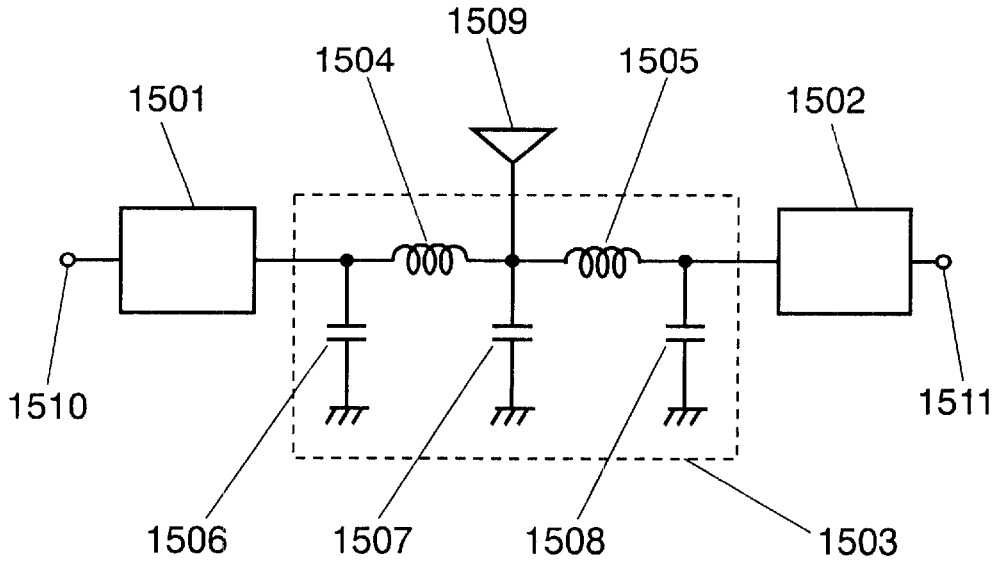
FIG. 15 Prior Art
FIG. 15 is circuit diagram of a duplexer of the prior art.

FIG. 13 is an exploded perspective view of a duplexer of a fifth exemplary embodiment of the present invention.

In FIG. 13, the duplexer having an integrated configuration comprises: dielectric layers 1301*a*, 1301*b*, 1301*c*, 1301*d*, 1301*e* and 1301*f*; resonator electrodes 1302*a*, 1302*b*, 1302*c* and 1302*d*; input-to-output transmission line electrodes 1303*a*, 1303*b* and 1303*c*; filtering capacitor electrodes 1304*a* and 1304*b*; a transmission line electrode 1305; load capacitor electrodes 1306*a* and 1306*b*; an inter-resonator coupling capacitor electrode 1307; input/output coupling capacitor electrodes 1308*a* and 1308*b*; a transmission line electrode 1309; a capacitor electrode 1310, another capacitor electrode 1311; and shielding electrodes 1312*a* and 1312*b*. One ends of the electrodes 1302*a*, 1302*b*, 1302*c* and 1302*d*, and the electrodes 1312*a* and 1312*b* are connected to a grounding terminal electrode 1314*a* provided on a side surface of a dielectric. The other ends of the electrodes 1302*a* and 1302*b* are connected respectively to frequency adjusting terminal electrodes 1315*a* and 1315*b* provided on another side surface of the dielectric. One ends of the electrodes 1306*a* and 1306*b*, and the electrodes 1312*a* and 1312*b* are connected to another grounding terminal electrode 1314*c* provided on another side surface of the dielectric. One end of the electrode 1303*a* is connected to an input/output terminal electrode 1313*a* provided on a side surface of the dielectric, and the other end of the electrode 1303*a* is connected to one end of the electrode 1303*b* and the electrode 1304*a*. The other end of the electrode 1303*b* and one end of the electrode 1303*c* are connected to the electrode 1304*b*. The other end of the electrode 1303*c*, one end of the electrode 1310, one end of the electrode 1308*a*, and one end of the electrode 1311 are connected to a common terminal electrode 1316 provided on a side surface of the dielectric. One end of the electrode 1308*b* is connected to an electrode 1313*b*. The electrodes 1312*a* and 1312*b* are connected to an electrode 1314*b*, and the electrodes 1314*a*, 1314*b*, and 1314*c* are grounded.

The operation of the duplexer constructed above will be described below.

The electrodes 1302*a* and 1302*b* act as quarter-wave resonators, since they are grounded via the electrode 1314*a*. The electrodes 1304*a* and 1304*b* are arranged in positions to overlap respectively with portions of the electrodes 1302*a* and 1302*b*, to form capacitors via the dielectric layer 1301*d*. Therefore, the two resonators are in series connection to the input-to-output terminal transmission lines 1303*a* , 1303*b* and 1303*c* via the capacitors, and thereby they function as two sets of BEF which provide a high magnitude of attenuation at resonance frequencies of the series resonance circuits comprising the electrodes 1302*a* and 1302*b*. Furthermore, the transmission lines 1303*a*, 1303*b* and 1303*c* function as coupling elements between two resonators, and also with an external distributed constant lines, by way of adjusting lengths and line widths of the transmission lines 1303*a*, 1303*b* and 1303*c*. Accordingly, the two resonators are in parallel connection via the transmission lines, thereby functioning as a two resonator BEF having the electrode 1313*a* and the common terminal electrode 1316 serving as input/output terminals.

In addition, the electrodes 1302*c* and 1302*d* act as quarter-wave resonators, as they are grounded via the electrode 1314*a*. The electrodes 1306*a* and 1306*b* comprise capacitors via the dielectric layer 1301*d*, since they are arranged in such positions that portions of them overlap with open ends of the respective electrodes 1302*c* and 1302*d*. These capacitors function as loading capacitors for adjusting resonance frequencies of the resonators, since the electrodes 1306*a* and 1306*b* are grounded via the grounding terminal electrode 1314*c*. The electrode 1307 comprises capacitors with the electrodes 1302*c* and 1302*d* via the dielectric layer 1301*d*, since it is arranged in a position that portions of it overlap with the electrodes 1302*c* and 1302*d*. These two capacitors function as inter-resonator coupling capacitors. The electrodes 1308*a* and 1308*b* comprise capacitors via the dielectric layer 1301*d*, since they are arranged in such positions that portions of them overlap with potions of the respective electrodes 1302*c* and 1302*d*, and these capacitors function as input/output coupling capacitors. Accordingly, the laminated body of this exemplary embodiment comprises a tri-plate structure sandwiched between the shielding electrodes on top and bottom, and it functions as a two resonator mono-polar type BPF of capacitive coupling type having one attenuation pole formed by an electromagnetic coupling between the two resonators and the inter-resonator coupling capacitors.

Furthermore, the transmission line electrode 1305 is branched off from the electrode 1303*c*, and it is arranged so that a portion of it overlaps with the electrode 1310. With this arrangement, the electrode 1305 and the electrode 1310 form a capacitor via the dielectric layer 1301 c, and constitute a parallel circuit with the electrode 1303*c*.

In addition, the electrode 1309 is also branched off from the electrode 1308*a*, and it is arranged so that a portion of it overlaps with the electrode 1311. With this arrangement, the electrode 1309 and the electrode 1311 form a capacitor via the dielectric layer 1301*c*, and comprise a parallel circuit with the electrode 1308*a*.

In this embodiment, each of the electrodes of this laminated filter is designed in such a manner that a pass band and an attenuation band of the above-said BEF, respectively, become a first band and a second band, and an attenuation band and a pass band of the above-said BPF respectively become the first band and the second band. An inductance "Lt" and a capacitance "Ct" are further adjusted so as to satisfy the following simultaneous equations:

$$1/(j\cdot\omega 1\cdot Lt\mathbf{0})=j\cdot\omega 1\cdot Ct+1/(j\cdot\omega 1\cdot Lt)\quad \omega_2^2=1/(Lt\cdot Ct) \qquad \text{(equations 5)}$$

where ω1 represents a frequency in the first band, $\omega_2$ a frequency in the second band, Lt0 an inductance of the electrode 1303*c* before the electrodes 1305 and 1310 are inserted, Lt an inductance of the electrode 1303*c* after the electrodes 1305 and 1310 are inserted, and Ct a capacitance of the capacitor formed between the electrodes 1305 and 1310.

In this embodiment, the BEF shows a passing characteristic having an additional attenuation pole in the vicinity of the second band while maintaining its original filter characteristic, since it has a parallel resonance circuit between the input/output terminals because it is provided with a resonance point in the second band without causing a disorder to an impedance in the first band.

In addition, an inductance "Lr" and a capacitance "Cr" are adjusted to satisfy the following simultaneous equations:

$$1/(j\cdot\omega\mathbf{2}\cdot Lr\mathbf{0})=j\cdot\omega\mathbf{2}\cdot Cr+1/(j\cdot\omega\mathbf{2}\cdot Lr)\quad \omega_1^2=1/(Lr\cdot Cr) \qquad \text{(equation 6)}$$

where Lr0 represents an inductance of the electrode 1308*c* before the electrodes 1309 and 1311 are inserted, Lr an inductance of the electrode 1308*c* after the electrodes 1309 and 1311 are inserted, and Cr a capacitance of the parallel plate capacitor formed between the electrodes 1309 and 1311. With this structure, the BPF shows a passing characteristic having an additional attenuation pole near the first band while maintaining its original filter characteristic, since it has a parallel resonance circuit between the input/output terminals because it is provided with a resonance point in the first band without causing a disorder to an impedance in the second band.

When electrodes are individually set under the above conditions, a signal input to the electrode 1313*a* is routed through the BEF, but only a signal component of the first band passes through, and is output from the electrode 1316. However, the signal does not flow from the electrode 1316 toward the BPF side, since the parallel circuit formed by the electrode 1308*a*, the electrode 1309, and the electrode 1311 provides a high impedance in the first band in light of the radio frequencies. Also, a signal in the second band input to the electrode 1316 does not flow toward the BEF side, since the parallel circuit formed by the electrode 1303*a*, the electrode 1305, and the electrode 1310 provides a high impedance in the second band in light of the radio frequencies. Hence, a majority of it flows into the BPF side, and only a signal component of the second band is output from the electrode 1313*b*.

With the structure described above, the duplexer of this exemplary embodiment comprising a single element can separate signals of the first band and signals of the second band without using a phase-shifting circuit. As a result, this duplexer can be useful for a system having a channel requiring a low loss in the first band and a high attenuation in the second band, and another channel needing a high attenuation at both sides of the second band.

In the present exemplary embodiment, although the duplexer comprises a single element using a laminated body, it is not necessarily comprised of a single element. It may comprise two elements using a BEF provided with a pass band in the first band and an attenuation band in the second band as described in the second exemplary embodiment, and a BPF provided with an attenuation band in the first band and a pass band in the second band as described in the first exemplary embodiment, wherein the two elements are connected together at each side of their input/output terminal electrodes where a parallel circuit is formed. This structure improves an efficiency of mounting on a substrate.

Although the duplexer of this exemplary embodiment comprises of the BEF provided with a pass band in the first band and an attenuation band in the second band, and the BPF provided with an attenuation band in the first band and a pass band in the second band, it may comprise a BPF provided with a pass band in the first band and an attenuation band in the second band as described in the first exemplary embodiment, and a BEF provided with an attenuation band in the first band and a pass band in the second band as described in the second exemplary embodiment. In this case, it functions as a duplexer useful for a system having a channel requiring a high attenuation at both sides of the first band, and another channel needing a high attenuation in the first band and a low loss in the second band.

Furthermore, the duplexer may be a structure using a BPF provided with a pass band in the first band and an attenuation band in the second band as described in the first exemplary embodiment, and a BEF provided with an attenuation band in the first band and a pass band in the second band as described in the second exemplary embodiment, wherein the two filters are connected together at each side of their input/output terminal electrodes where a parallel circuit is formed. The duplexer may also comprise a BPF provided with a pass band in the first band and an attenuation band in the second band as described in the first exemplary embodiment, and another BPF provided with an attenuation band in the first band and a pass band in the second band as also described in the first exemplary embodiment. In this case, it functions as a duplexer useful for a system having a channel requiring a high attenuation at both sides of the first band, and another channel requiring a high attenuation at both sides of the second band.

Besides, the duplexer may be a structure comprising a BPF provided with a pass band in the first band and an attenuation band in the second band as described in the first exemplary embodiment, and another BPF provided with an attenuation band in the first band and a pass band in the second band as also described in the first exemplary embodiment, wherein the two filters are connected together at each side of their input/output terminal electrodes where a parallel circuit is formed.

Moreover, the duplexer may also comprise a BEF provided with a pass band in the first band and an attenuation band in the second band as described in the second exemplary embodiment, and another BEF provided with an attenuation band in the first band and a pass band in the second band as described also in the second exemplary embodiment. In this case, it functions as a duplexer useful for a system having a channel requiring a low loss in the first band and a high attenuation in the second band, and another channel needing a high attenuation in the first band and a low loss in the second band.

Also, the duplexer may comprise a structure using individually a BEF provided with a pass band in the first band and an attenuation band in the second band as described in the second exemplary embodiment, and another BEF provided with an attenuation band in the first band and a pass band in the second band as described also in the second exemplary embodiment, wherein the two filters are connected together at each side of their input/output terminal electrodes where a parallel circuit is formed.

Also, the duplexer may comprise an LPF provided with a pass band in the first band and an attenuation band in the second band as described in the third exemplary embodiment, and a BPF provided with an attenuation band in the first band and a pass band in the second band as described also in the first exemplary embodiment. In this case, it functions as a duplexer useful for a system having a channel requiring a low loss in the first band and another channel needing a high attenuation at both sides of the second band.

Further, the duplexer may be constructed comprising individually an LPF provided with a pass band in the first band and an attenuation band in the second band as described in the third exemplary embodiment, and a BPF provided with an attenuation band in the first band and a pass band in the second band as described in the first exemplary embodiment, wherein the two filters are connected together at each side of their input/output terminal electrodes where a parallel circuit is formed.

Furthermore, the duplexer may comprise a BPF provided with a pass band in the first band and an attenuation band in the second band as described in the first exemplary embodiment, and an HPF provided with an attenuation band in the first band and a pass band in the second band as described in the fourth exemplary embodiment. In this case, it functions as a duplexer useful for a system having a channel requiring a high attenuation at both sides of the first band and another channel needing a low loss in the second band.

Moreover, the duplexer may be constructed comprising individually a BPF provided with a pass band in the first band and an attenuation band in the second band as described in the first exemplary embodiment, and an HPF provided with an attenuation band in the first band and a pass band in the second band as described in the fourth exemplary embodiment, wherein the two filters are connected together at each side of their input/output terminal electrodes where a parallel circuit is formed.

Also, the duplexer may comprise a BEF provided with a pass band in the first band and an attenuation band in the second band as described in the second exemplary embodiment, and an HPF provided with an attenuation band in the first band and a pass band in the second band as described in the fourth exemplary embodiment. In this case, it functions as a duplexer useful for a system having a channel requiring a low loss in the first band and a high attenuation in the second band, and another channel needing a low loss in the second band.

In addition, the duplexer may comprise a BEF provided with a pass band in the first band and an attenuation band in the second band as described in the second exemplary embodiment, and an HPF provided with an attenuation band in the first band and a pass band in the second band as described in the fourth exemplary embodiment, wherein the two filters are connected together at each side of their input/output terminal electrodes where a parallel circuit is formed.

Also, the duplexer may comprise an LPF provided with a pass band in the first band and an attenuation band in the second band as described in the third exemplary embodiment, and a BEF provided with an attenuation band in the first band and a pass band in the second band as described in the second exemplary embodiment. In this case, it functions as a duplexer useful for a system having a channel requiring a low loss in the first band, and another channel needing a high attenuation in the first band and a low loss in the second band.

Moreover, the above duplexer may comprise an LPF provided with a pass band in the first band and an attenuation band in the second band as described in the third exemplary embodiment, and a BEF provided with an attenuation band in the first band and a pass band in the second band as described in the second exemplary embodiment, wherein the two filters are connected together at each side of their input/output terminal electrodes where a parallel circuit is formed.

Furthermore, the duplexer may comprise an LPF provided with a pass band in the first band and an attenuation band in the second band as described in the third exemplary embodiment, and an HPF provided with an attenuation band in the first band and a pass band in the second band as described in the fourth exemplary embodiment. In this case, it functions as a duplexer useful for a system having a channel requiring a low loss in the first band, and another channel needing a low loss in the second band.

Also, the above duplexer may comprise an LPF provided with a pass band in the first band and an attenuation band in the second band as described in the third exemplary embodiment, and an HPF provided with an attenuation band in the first band and a pass band in the second band as described in the fourth exemplary embodiment, wherein the two filters are connected together at each side of their input/output terminal electrodes where a parallel circuit is formed.

In addition, since the phase-shifting circuit that had been needed in the past can be eliminated in a mobile communication apparatus by employing a duplexer of this invention, the mobile communication apparatus can be constructed smaller in size.

As has been described, the present invention can realize a laminated filter of a high magnitude of attenuation with a same size as before. In addition, it can also realize a duplexer without using the phase-shifting circuit.

What is claimed is:

1. A laminated filter comprising:

input/output terminals;

at least one capacitor comprising at least a portion of an electrode connecting directly to one of said input/output terminals, as one electrode, and another electrode connecting directly to said one input/output terminal, wherein said electrode connecting directly to said one input/output terminal and said capacitor form a parallel circuit;

a plurality of resonators;

an inter-resonator coupling capacitor for coupling said plurality of resonators; and an input/output coupling capacitor for coupling said plurality of resonators to said input/output terminal.

2. The laminated filter according to claim 1, wherein said capacitor comprises one of the electrodes comprising at least a portion of a transmission line branched off from one electrode of said input/output coupling capacitor, said one electrode connecting directly to said input/output terminal.

3. The laminated filter according to claim 1, wherein a resonance frequency of said parallel circuit is within an attenuation band of said laminated filter.

4. The laminated filter according to claim 1, wherein said parallel circuit is formed in both of said input/output terminals.

5. A laminated filter comprising:

input/output terminals;

at least one capacitor comprising at least a portion of an electrode connecting directly to one of said input/output terminals, as one electrode, and another electrode connecting directly to said one input/output terminal, wherein said electrode connecting directly to said one input/output terminal and said capacitor form a parallel circuit;

a transmission line for connecting between both of said electrodes connecting directly to said input/output terminals; and a capacitor for coupling said transmission line to a ground;

wherein said capacitor comprises one side of electrodes comprising at least a portion of a transmission line branched off from said transmission line.

6. The laminated filter according to claim 5 wherein said parallel circuit is formed in both of said input/output terminals.

7. A laminated filter comprising:

input/output terminals;

at least one capacitor comprising at least a portion of an electrode connecting directly to one of said input/output terminals, as one electrode, and another electrode connecting directly to said one input/output terminal, wherein said electrode connecting directly to said one input/output terminal and said capacitor form a parallel circuit;

at least one transmission line wherein portions thereof overlap with both of said electrodes connecting directly to said input/output terminals; and a transmission line connecting between said transmission line to a ground.

8. The laminated filter according to claim 7, wherein said capacitor comprises one side of electrodes comprising at least a portion of a transmission line branched off from one of said electrodes connecting directly to said input/output terminals.

9. The laminated filter according to claim 7, wherein said parallel circuit is formed in both of said input/output terminals.

10. A duplexer having two laminated filters, comprising:

two laminated filters having at least one capacitor, wherein one side of electrodes of said capacitor comprises any one of (a) at least a portion of an electrode connecting directly to one of input/output terminals, and (b) at least a portion of a transmission line branched off from said electrode connecting directly to said one input/output terminal, and the other side of electrodes connects directly to said one input/output terminal, and said electrode connecting directly to said one input/output terminal forms a parallel circuit with said capacitor, wherein said two laminated filters are connected together at each side of said one input/output terminal where said parallel circuit is formed, to comprise a common terminal;

wherein said two laminated filters comprise a first filter and a second filter, said first filter comprising:

a plurality of first resonators;

an inter-resonator coupling capacitor for coupling between said first resonators; and an input/output coupling capacitor for coupling said first resonators and said input/output terminals individually, and said second filter comprising:

a transmission line for connecting between both of said electrodes connecting directly to said input/output terminals;

a plurality of capacitors; and a plurality of second resonators, wherein said transmission line and each of said second resonators are individually connected by said capacitors.

11. The duplexer according to claim 10, wherein:

said first filter is provided with an attenuation band in a first band and a pass band in a second band, and a resonance frequency of said parallel circuit of said first filter is in the vicinity of said first band; and said second filter is provided with a pass band in said first band and an attenuation band in said second band, and a resonance frequency of said parallel circuit of said second filter is in the vicinity of said second band.

12. The duplexer according to claim 10, wherein:

said first filter is provided with a pass band in a first band and an attenuation band in a second band, and a resonance frequency of said parallel circuit of said first filter is in the vicinity of said second band; and said second filter is provided with an attenuation band in said first band and a pass band in said second band, and a resonance frequency of said parallel circuit of said second filter is in the vicinity of said first band.

13. The duplexer according to claim 10, having an integrated structure containing said first and said second filters within a dielectric.

14. The duplexer according to claim 10, wherein said two laminated filters comprise a first filter and a second filter, said first filter comprising:

a plurality of first resonators;

a first inter-resonator coupling capacitor for coupling between said first resonators; and a first input/output coupling capacitor for coupling said first resonators and said input/output terminals individually, and said second filter comprising:

a plurality of second resonators;

a second inter-resonator coupling capacitor for coupling between said second resonators; and a second input/output coupling capacitor for coupling said second resonators and said input/output terminals individually.

15. The duplexer according to claim 14, wherein:

one of said first filter and said second filter is provided with an attenuation band in a first band and a pass band in a second band, and a resonance frequency of said parallel circuit of said one filter is in the vicinity of said first band; and another of said first filter and said second filter is provided with a pass band in said first band and an attenuation band in said second band, and a resonance frequency of said parallel circuit of said another filter is in the vicinity of said second band.

16. The duplexer according to claim 14, having an integrated structure containing said first and said second filters within a dielectric.

17. The duplexer according to claim 10, wherein said two laminated filters comprise a first filter and a second filter, said first filter comprising:

a plurality of resonators;

an inter-resonator coupling capacitor for coupling between said resonators; and an input/output coupling capacitor for coupling said resonators and said input/output terminals individually, and said second filter comprising:

a transmission line for connecting between both of said electrodes connecting directly to said input/output terminals; and a capacitor for coupling said transmission line to a ground.

18. The duplexer according to claim 17, wherein:

said first filter is provided with an attenuation band in a first band and a pass band in a second band, and a resonance frequency of said parallel circuit of said first filter is in the vicinity of said first band; and said second filter is provided with a pass band in said first band, and a resonance frequency of said parallel circuit of said second filter is in the vicinity of said second band.

19. The duplexer according to claim 17, having an integrated structure containing said first and said second filters within a dielectric.

20. The duplexer according to claim 10, wherein said two laminated filters comprise a first filter and a second filter, said first filter comprising:

at least one transmission line wherein portions thereof overlap with both of said electrodes connecting directly to said input/output terminals; and another transmission line for connecting between said transmission line and a ground, and said second filter comprising:

a plurality of resonators;

an inter-resonator coupling capacitor for coupling between said resonators; and an input/output coupling capacitor for coupling said resonators and said input/output terminals individually.

21. The duplexer according to claim 20, wherein:

said first filter is provided with a pass band in a second band, and a resonance frequency of said parallel circuit of said first filter is in the vicinity of a first band; and said second filter is provided with a pass band in said first band and an attenuation band in said second band, and a resonance frequency of said parallel circuit of said second filter is in the vicinity of said second band.

22. The duplexer according to claim 20, having an integrated structure containing said first and said second filters within a dielectric.

23. The duplexer according to claim 10, wherein said two laminated filters comprise a first filter and a second filter, said first filter comprising:

at least one transmission line wherein portions thereof overlap with both of said electrodes connecting directly to said input/output terminals; and another transmission line for connecting between said transmission line and a ground, and said second filter comprising:

a transmission line for connecting between both of said electrodes connecting directly to said input/output terminals;

a plurality of capacitors;

a plurality of resonators, and having a structure connecting said transmission line and each of said resonators individually by said capacitors.

24. The duplexer according to claim 23, wherein:

said first filter is provided with a pass band in a second band, and a resonance frequency of said parallel circuit of said first filter is in the vicinity of a first band; and said second filter is provided with a pass band in said first band and an attenuation band in said second band, and a resonance frequency of said parallel circuit of said second filter is in the vicinity of said second band.

25. The duplexer according to claim 23, having an integrated structure containing said first and said second filters within a dielectric.

26. The duplexer according to claim 10, wherein said two laminated filters comprise a first filter and a second filter, said first filter comprising:

at least one transmission line wherein portions thereof overlap with both of said electrodes connecting directly to said input/output terminals; and another transmission line for connecting between said transmission line and a ground, and said second filter comprising:

a transmission line for connecting between both of said electrodes connecting directly to said input/output terminals; and a capacitor for coupling said transmission line to a ground.

27. The duplexer according to claim 26, wherein:

said first filter is provided with a pass band in a second band, and a resonance frequency of said parallel circuit of said first filter is in the vicinity of a first band; and said second filter is provided with a pass band in said first band, and a resonance frequency of said parallel circuit of said second filter is in the vicinity of said second band.

28. The duplexer according to claim 26, having an integrated structure containing said first and said second filters within a dielectric.

* * * * *